US010313815B2

(12) United States Patent
Kuech et al.

(10) Patent No.: US 10,313,815 B2
(45) Date of Patent: Jun. 4, 2019

(54) APPARATUS AND METHOD FOR GENERATING A PLURALITY OF PARAMETRIC AUDIO STREAMS AND APPARATUS AND METHOD FOR GENERATING A PLURALITY OF LOUDSPEAKER SIGNALS

(71) Applicants: Fraunhofer-Gesellschaft zur Foerderung der angewandten Forschung e.V., Munich (DE); Technische Universitaet Ilmenau, Ilmenau (DE)

(72) Inventors: Fabian Kuech, Erlangen (DE); Giovanni Del Galdo, Martinroda (DE); Achim Kuntz, Hemhofen (DE); Ville Pulkki, Espoo (FI); Archontis Politis, Helsinki (FI)

(73) Assignees: Fraunhofer-Gesellschaft zur Foerderung der angewandten Forschung e.V., Munich (DE); Technische Universitaet Ilmenau, Ilmenau (DE)

( * ) Notice: Subject to any disclaimer, the term of this patent is extended or adjusted under 35 U.S.C. 154(b) by 0 days.

(21) Appl. No.: 14/712,576

(22) Filed: May 14, 2015

(65) Prior Publication Data

US 2015/0249899 A1 Sep. 3, 2015

Related U.S. Application Data

(63) Continuation of application No. PCT/EP2013/073574, filed on Nov. 12, 2013.
(Continued)

(30) Foreign Application Priority Data

Mar. 15, 2013 (EP) ..... 13159421

(51) Int. Cl.
*H04S 5/00* (2006.01)
*H04S 7/00* (2006.01)
(Continued)

(52) U.S. Cl.
CPC ..... *H04S 5/005* (2013.01); *G10L 19/008* (2013.01); *G10L 19/08* (2013.01); *H04S 3/002* (2013.01);
(Continued)

(58) Field of Classification Search
CPC ..... G10L 19/008; G10L 19/08; H04S 7/30; H04S 3/002; H04S 5/005
See application file for complete search history.

(56) References Cited

U.S. PATENT DOCUMENTS 6,021,206 A 2/2000 McGrath
7,787,638 B2 8/2010 Lokki et al.
(Continued)

FOREIGN PATENT DOCUMENTS

CN 101518103 A 8/2009
CN 101658052 A 2/2010
(Continued)

OTHER PUBLICATIONS

Ahonen, J. et al., "Diffuseness Estimation Using Temporal Variation of Intensity Vectors", 2009 IEEE Workshop on Applications of Signal Processing to Audio and Acoustics Oct. 18-21, 2009, New Paltz, NY Department of Signal Processing and Acoustics, Helsinki University of Technology (TKK) P.O.Box 3000, FI-02015 TKK, Finland.
(Continued)

*Primary Examiner* — Paul W Huber
(74) *Attorney, Agent, or Firm* — Perkins Coie LLP; Michael A. Glenn

(57) ABSTRACT

An apparatus for generating a plurality of parametric audio streams from an input spatial audio signal obtained from a
(Continued)

recording in a recording space has a segmentor and a generator. The segmentor is configured for providing at least two input segmental audio signals from the input spatial audio signal, wherein the at least two input segmental audio signals are associated with corresponding segments of the recording space. The generator is configured for generating a parametric audio stream for each of the at least two input segmental audio signals to obtain the plurality of parametric audio streams.

14 Claims, 11 Drawing Sheets

Related U.S. Application Data

(60) Provisional application No. 61/726,887, filed on Nov. 15, 2012.

(51) Int. Cl.
*G10L 19/008* (2013.01)
*G10L 19/08* (2013.01)
*H04S 3/00* (2006.01)

(52) U.S. Cl.
CPC ..... *H04S 7/30* (2013.01); *H04S 2400/01* (2013.01); *H04S 2400/11* (2013.01); *H04S 2400/15* (2013.01); *H04S 2420/03* (2013.01); *H04S 2420/11* (2013.01)

(56) References Cited

U.S. PATENT DOCUMENTS

| | | | |
|---|---|---|---|
| 2006/0171547 | A1 | 8/2006 | Lokki et al. |
| 2008/0232601 | A1 | 9/2008 | Pulkki |
| 2011/0033063 | A1 | 2/2011 | McGrath et al. |
| 2011/0040398 | A1 | 2/2011 | Hotho et al. |
| 2011/0216908 | A1 | 9/2011 | Galdo et al. |
| 2012/0114126 | A1 | 5/2012 | Thiergart et al. |
| 2012/0128160 | A1 | 5/2012 | Kim et al. |
| 2013/0016842 | A1 | 1/2013 | Schultz-Amling et al. |

FOREIGN PATENT DOCUMENTS

| | | | |
|---|---|---|---|
| CN | 202153724 | U | 2/2012 |
| EP | 1558061 | A2 | 7/2005 |
| EP | 2346028 | A1 | 7/2011 |
| JP | H04158000 | A | 5/1992 |
| JP | 7123499 | A | 5/1995 |
| JP | 2010521909 | A | 6/2010 |
| JP | 2011517547 | A | 6/2011 |
| JP | 2011530720 | A | 12/2011 |
| JP | 2012526296 | A | 10/2012 |
| JP | 2013514696 | A | 4/2013 |
| JP | 2014501064 | A | 1/2014 |
| RU | 2382419 | C2 | 2/2010 |
| WO | 2008113427 | A1 | 9/2008 |

OTHER PUBLICATIONS

Farina, Angelo et al., "Ambiophonic Principles for the Recording and Reproduction of Surround Sound for Music", XP-00271755.
Kallinger, Markus et al., "A Spatial Filtering Approach for Directional Audio Coding", 126th AES Convention. Munich, Germany., May 7, 2009, 10 Pages.
Kuntz, Achim, "Wave Field Analysis Using Virtual Circular Microphone Arrays", Erlangen, 2008.
Pulkki, "Spatial Sound Reproduction with Directional Audio Coding*", Laboratory of Acoustics and Audio Signal Processing, Helsinki University of Technology, FI-02015 TKK, Finland; J. Audio Eng. Soc., vol. 55, No. 6., Jun. 2007.
Pulkki, V et al., "Virtual Sound Source Positioning Using Vector Base Amplitude Panning", Journal of Audio Eng. Soc. vol. 45, No. 6., Jun. 1997, 456-466.
Pulkki, Ville et al., "Efficient spatial sound synthesis for virtual worlds", Ville Pulkki, Mikko-Ville Laitinen, Cumhur Erkut Dept. Signal Processing and Acoustics, Helsinki University of Technology, POBox 3000, FI-02015, Finland Correspondence should be addressed to Ville Pulkki (Ville. Pulkki<Otkk. f i).
Roy, R. et al., "ESPRIT—Estimation of Signal Parameters Via Rotational Invariance Techniques", IEEE Transactions on Acoustics, Speech, and Signal Processing, vol. 37, No. 7, Jul. 1989, 984-995.
Thiergart, Oliver et al., "Signal-To-Reverberant Ratio Estimation Based on the Complex Spatial Coherence Between Omnidirectional Microphones".

APPARATUS AND METHOD FOR GENERATING A PLURALITY OF PARAMETRIC AUDIO STREAMS AND APPARATUS AND METHOD FOR GENERATING A PLURALITY OF LOUDSPEAKER SIGNALS

CROSS-REFERENCE TO RELATED APPLICATIONS

This application is a continuation of copending International Application No. PCT/EP2013/073574, filed Nov. 12, 2013, which is incorporated herein by reference in its entirety, and additionally claims priority from U.S. Application No. 61/726,887, filed Nov. 15, 2012, and European Application No. 13159421.0, filed Mar. 15, 2013, both of which are also incorporated herein by reference in their entirety.

The present invention generally relates to a parametric spatial audio processing, and in particular to an apparatus and a method for generating a plurality of parametric audio streams and an apparatus and a method for generating a plurality of loudspeaker signals. Further embodiments of the present invention relate to a sector-based parametric spatial audio processing.

BACKGROUND OF THE INVENTION

In multichannel listening, the listener is surrounded with multiple loudspeakers. A variety of known methods exist to capture audio for such setups. Let us first consider loudspeaker systems and the spatial impression that can be created with them. Without special techniques, common two-channel stereophonic setups can only create auditory events on the line connecting the loudspeakers. Sound emanating from other directions cannot be produced. Logically, by using more loudspeakers around the listener, more directions can be covered and a more natural spatial impression can be created. The most well known multichannel loudspeaker system and layout is the 5.1 standard ("ITU-R 775-1"), which consists of five loudspeakers at azimuthal angles of 0°, 30° and 110° with respect to the listening position. Other systems with a varying number of loudspeakers located at different directions are also known.

In the art, several different recording methods have been designed for the previously mentioned loudspeaker systems, in order to reproduce the spatial impression in the listening situation as it would be perceived in the recording environment. The ideal way to record spatial sound for a chosen multichannel loudspeaker system would be to use the same number of microphones as there are loudspeakers. In such a case, the directivity patterns of the microphones should also correspond to the loudspeaker layout such that sound from any single direction would only be recorded with one, two, or three microphones. The more loudspeakers are used, the narrower directivity patterns are thus needed. However, such narrow directional microphones are relatively expensive, and have typically a non-flat frequency response, which is not desired. Furthermore, using several microphones with too broad directivity patterns as input to multichannel reproduction results in a colored and blurred auditory perception, due to the fact that sound emanating from a single direction is usually reproduced with more loudspeakers than is useful. Hence, current microphones are best suited for two-channel recording and reproduction without the goal of a surrounding spatial impression.

Another known approach to spatial sound recording is to record a large number of microphones which are distributed over a wide spatial area. For example, when recording an orchestra on a stage, the single instruments can be picked up by so-called spot microphones, which are positioned closely to the sound sources. The spatial distribution of the frontal sound stage can, for example, be captured by conventional stereo microphones. The sound field components corresponding to the late reverberation can be captured by several microphones placed at a relatively far distance to the stage. A sound engineer can then mix the desired multichannel output by using a combination of all microphone channels available. However, this recording technique implies a very large recording setup and hand crafted mixing of the recorded channels, which is not always feasible in practice.

Conventional systems for the recording and reproduction of spatial audio based on directional audio coding (DirAC), as described in T. Lokki, J. Merimaa, V. Pulkki: Method for Reproducing Natural or Modified Spatial Impression in Multichannel Listening, U.S. Pat. No. 7,787,638 B2, Aug. 31, 2010 and V. Pulkki: Spatial Sound Reproduction with Directional Audio Coding. J. Audio Eng. Soc., Vol. 55, No. 6, pp. 503-516, 2007, rely on a simple global model for the sound field. Therefore, they suffer from some systematic drawbacks, which limits the achievable sound quality and experience in practice.

A general problem of known solutions is that they are relatively complex and typically associated with a degradation of the spatial sound quality.

SUMMARY

According to an embodiment, an apparatus for generating a plurality of parametric audio streams from an input spatial audio signal acquired from a recording in a recording space may have: a segmentor for generating at least two input segmental audio signals from the input spatial audio signal; wherein the segmentor is configured to generate the at least two input segmental audio signals depending on corresponding segments of the recording space, wherein the segments of the recording space each represent a subset of directions within a two-dimensional plane or within a three-dimensional space, and wherein the segments are different from each other; and a generator for generating a parametric audio stream for each of the at least two input segmental audio signals to acquire the plurality of parametric audio streams, so that the plurality of parametric audio streams each include a component of the at least two input segmental audio signals and a corresponding parametric spatial information, wherein the parametric spatial information of each of the parametric audio steams includes direction-of-arrival parameter and/or a diffuseness parameter.

According to another embodiment, an apparatus for generating a plurality of loudspeaker signals from a plurality of parametric audio streams; wherein each of the plurality of parametric audio streams includes a segmental audio component and a corresponding parametric spatial information; wherein the parametric spatial information of each of the parametric audio steams includes a direction-of-arrival parameter and/or a diffuseness parameter; may have: a renderer for providing a plurality of input segmental loudspeaker signals from the plurality of parametric audio streams, so that the input segmental loudspeaker signals depend on corresponding segments of a recording space, wherein the segments of the recording space each represent a subset of directions within a two-dimensional plane or within a three-dimensional space, and wherein the segments are different from each other; wherein the renderer is configured for rendering each of the segmental audio components using the corresponding parametric spatial information to acquire the plurality of input segmental loudspeaker signals; and a combiner for combining the input segmental loudspeaker signals to acquire the plurality of loudspeaker signals.

According to another embodiment, a method for generating a plurality of parametric audio streams from an input spatial audio signal acquired from a recording in a recording space may have the steps of: generating at least two input segmental audio signals from the input spatial audio signal; wherein generating the at least two input segmental audio signals is conducted depending on corresponding segments of the recording space, wherein the segments of the recording space each represent a subset of directions within a two-dimensional plane or within a three-dimensional space, and wherein the segments are different from each other; generating a parametric audio stream for each of the at least two input segmental audio signals to acquire the plurality of parametric audio streams, so that the plurality of parametric audio streams each include a component of the at least two input segmental audio signals and a corresponding parametric spatial information, wherein the parametric spatial information of each of the parametric audio steams includes direction-of-arrival parameter and/or a diffuseness parameter.

According to another embodiment, a method for generating a plurality of loudspeaker signals from a plurality of parametric audio streams; wherein each of the plurality of parametric audio streams includes a segmental audio component and a corresponding parametric spatial information; wherein the parametric spatial information of each of the parametric audio steams includes a direction-of-arrival parameter and/or a diffuseness parameter; may have the steps of: providing a plurality of input segmental loudspeaker signals from the plurality of parametric audio streams, so that the input segmental loudspeaker signals depend on corresponding segments of a recording space, wherein the segments of the recording space each represent a subset of directions within a two-dimensional plane or within a three-dimensional space, and wherein the segments are different from each other; wherein providing the plurality of input segmental loudspeaker signals is conducted by rendering each of the segmental audio components using the corresponding parametric spatial information to acquire the plurality of input segmental loudspeaker signals; and combining the input segmental loudspeaker signals to acquire the plurality of loudspeaker signals.

According to another embodiment, a computer program including a program code for performing the method according to claim 11 when the computer program is executed on a computer.

According to another embodiment, a computer program including a program code for performing the method according to claim 12 when the computer program is executed on a computer.

The basic idea underlying the present invention is that the improved parametric spatial audio processing can be achieved if at least two input segmental audio signals are provided from the input spatial audio signal, wherein the at least two input segmental audio signals are associated with corresponding segments of the recording space, and if a parametric audio stream is generated for each of the at least two input segmental audio signals to obtain the plurality of parametric audio streams. This allows to achieve the higher quality, more realistic spatial sound recording and reproduction using relatively simple and compact microphone configurations.

According to a further embodiment, the segmentor is configured to use a directivity pattern for each of the segments of the recording space. Here, the directivity pattern indicates a directivity of the at least two input segmental audio signals. By the use of the directivity patterns, it is possible to obtain a better model match of the observed sound field, especially in complex sound scenes.

According to a further embodiment, the generator is configured for obtaining the plurality of parametric audio streams, wherein the plurality of parametric audio streams each comprise a component of the at least two input segmental audio signals and a corresponding parametric spatial information. For example, the parametric spatial information of each of the parametric audio streams comprises a direction-of-arrival (DOA) parameter and/or a diffuseness parameter. By providing the DOA parameters and/or the diffuseness parameters, it is possible to describe the observed sound field in a parametric signal representation domain.

According to a further embodiment, an apparatus for generating a plurality of loudspeaker signals from a plurality of parametric audio streams derived from an input spatial audio signal recorded in a recording space comprises a renderer and a combiner. The renderer is configured for providing a plurality of input segmental loudspeaker signals from the plurality of parametric audio streams. Here, the input segmental loudspeaker signals are associated with corresponding segments of the recording space. The combiner is configured for combining the input segmental loudspeaker signals to obtain the plurality of loudspeaker signals.

Further embodiments of the present invention provide methods for generating a plurality of parametric audio streams and for generating a plurality of loudspeaker signals.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
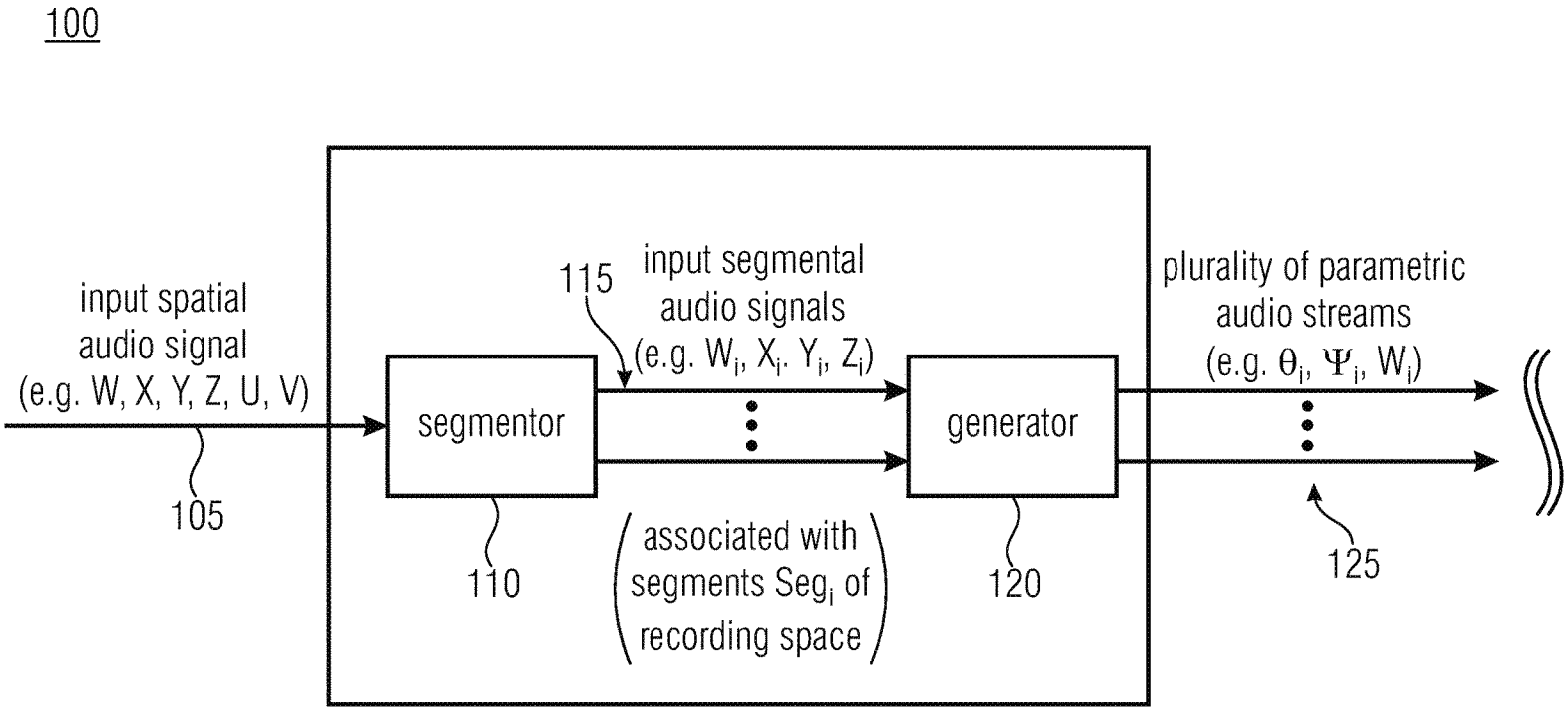
FIG. 1 shows a block diagram of an embodiment of an apparatus for generating a plurality of parametric audio streams from an input spatial audio signal recording in a recording space with a segmentor and a generator.

Before discussing the present invention in further detail using the drawings, it is pointed out that in the figures identical elements, elements having the same function or the same effect are provided with the same reference numerals so that the description of these elements and the functionality thereof illustrated in the different embodiments is mutually exchangeable or may be applied to one another in the different embodiments.

FIG. 1 shows a block diagram of an embodiment of an apparatus 100 for generating a plurality of parametric audio streams 125 ($\theta_i$, $\Psi_i$, $W_i$) from an input spatial audio signal 105 obtained from a recording in a recording space with a segmentor 110 and a generator 120. For example, the input spatial audio signal 105 comprises an omnidirectional signal W and a plurality of different directional signals X, Y, Z, U, V (or X, Y, U, V). As shown in FIG. 1, the apparatus 100 comprises a segmentor 110 and a generator 120. For example, the segmentor 110 is configured for providing at least two input segmental audio signals 115 ($W_i$, $X_i$, $Y_i$, $Z_i$) from the omnidirectional signal W and the plurality of different directional signals X, Y, Z, U, V of the input spatial audio signal 105, wherein the at least two input segmental audio signals 115 ($W_i$, $X_i$, $Y_i$, $Z_i$) are associated with corresponding segments $Seg_i$ of the recording space. Furthermore, the generator 120 may be configured for generating a parametric audio stream for each of the at least two input segmentor audio signals 115 ($W_i$, $X_i$, $Y_i$, $Z_i$) to obtain the plurality of parametric audio streams 125 ($\theta_i$, $\Psi_i$, $W_i$).

By the apparatus 100 for generating the plurality of parametric audio streams 125, it is possible to avoid a degradation of the spatial sound quality and to avoid relatively complex microphone configurations. Accordingly, the embodiment of the apparatus 100 in accordance with FIG. 1 allows for a higher quality, more realistic spatial sound recording using relatively simple and compact microphone configurations.

In embodiments, the segments $Seg_i$ of the recording space each represent a subset of directions within a two-dimensional (2D) plane or within a three-dimensional (3D) space.

In embodiments, the segments $Seg_i$ of the recording space each are characterized by an associated directional measure.

According to embodiments, the apparatus 100 is configured for performing a sound field recording to obtain the input spatial audio signal 105. For example, the segmentor 110 is configured to divide a full angle range of interest into the segments $Seg_i$ of the recording space. Furthermore, the segments $Seg_i$ of the recording space may each cover a reduced angle range compared to the full angle range of interest.

Figure 2:
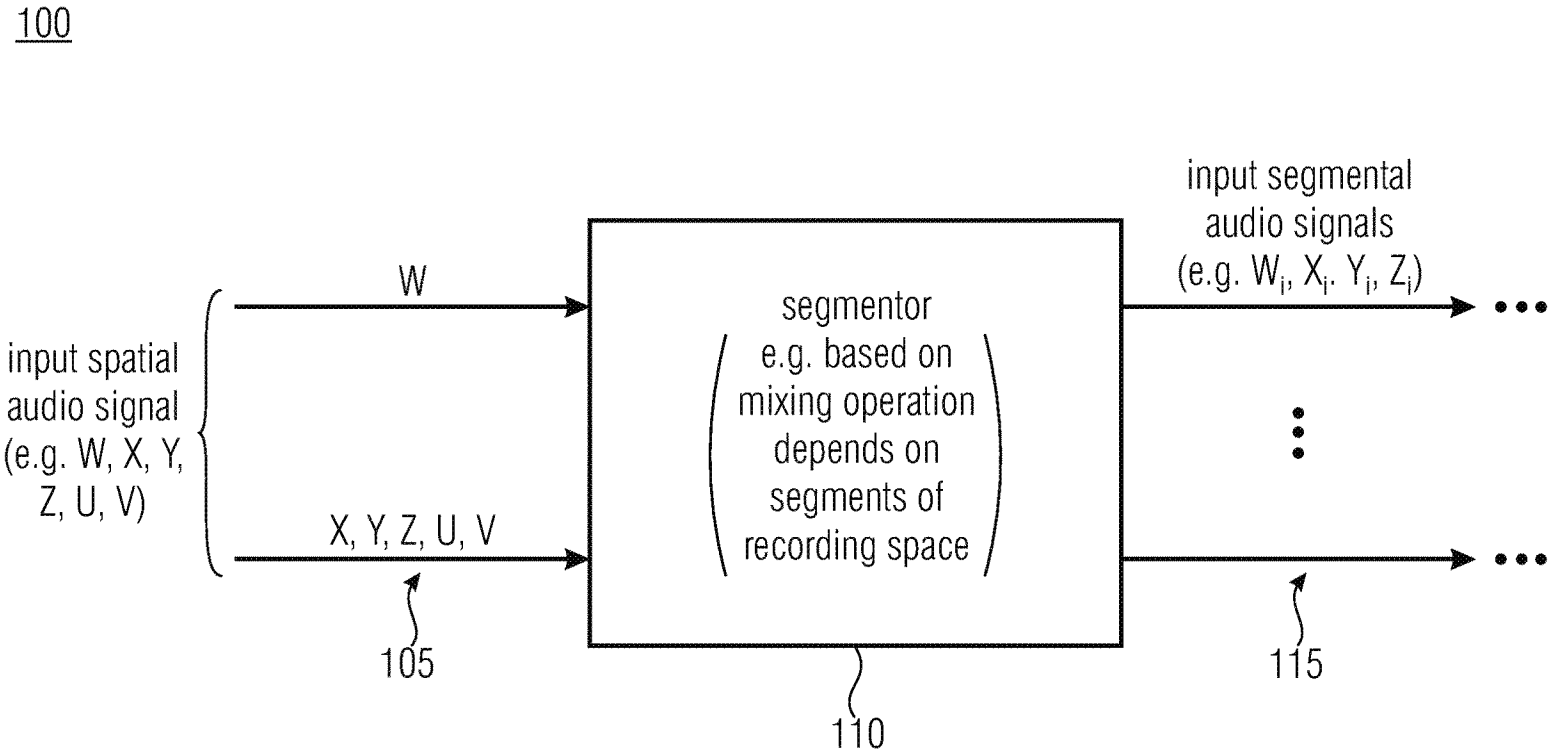
FIG. 2 shows a schematic illustration of the segmentor of the embodiment of the apparatus in accordance with FIG. 1 based on a mixing or matrixing operation.

FIG. 2 shows a schematic illustration of the segmentor 110 of the embodiment of the apparatus 100 in accordance with FIG. 1 based on a mixing (or matrixing) operation. As exemplarily depicted in FIG. 2, the segmentor 110 is configured to generate the at least two input segmental audio signals 115 ($W_i$, $X_i$, $Y_i$, $Z_i$) from the omnidirectional signal W and the plurality of different directional signals X, Y, Z, U, V using a mixing or matrixing operation which depends on the segments $Seg_i$ of the recording space. By the segmentor 110 exemplarily shown in FIG. 2, it is possible to map the omnidirectional signal W and the plurality of different directional signals X, Y, Z, U, V constituting the input spatial audio signal 105 to the at least two input segmental audio signal 115 ($W_i$, $X_i$, $Y_i$, $Z_i$) using a predefined mixing or matrixing operation. This predefined mixing or matrixing operation depends on the segments $Seg_i$ of the recording space and can substantially be used to branch off the at least two input segmental audio signals 115 ($W_i$, $X_i$, $Y_i$, $Z_i$) from the input spatial audio signal 105. The branching off of the at least two input segmental audio signals 115 ($W_i$, $X_i$, $Y_i$, $Z_i$) by the segmentor 110 which is based on the mixing or matrixing operation substantially allows to achieve the above mentioned advantages as opposed to a simple global model for the sound field.

Figure 3:
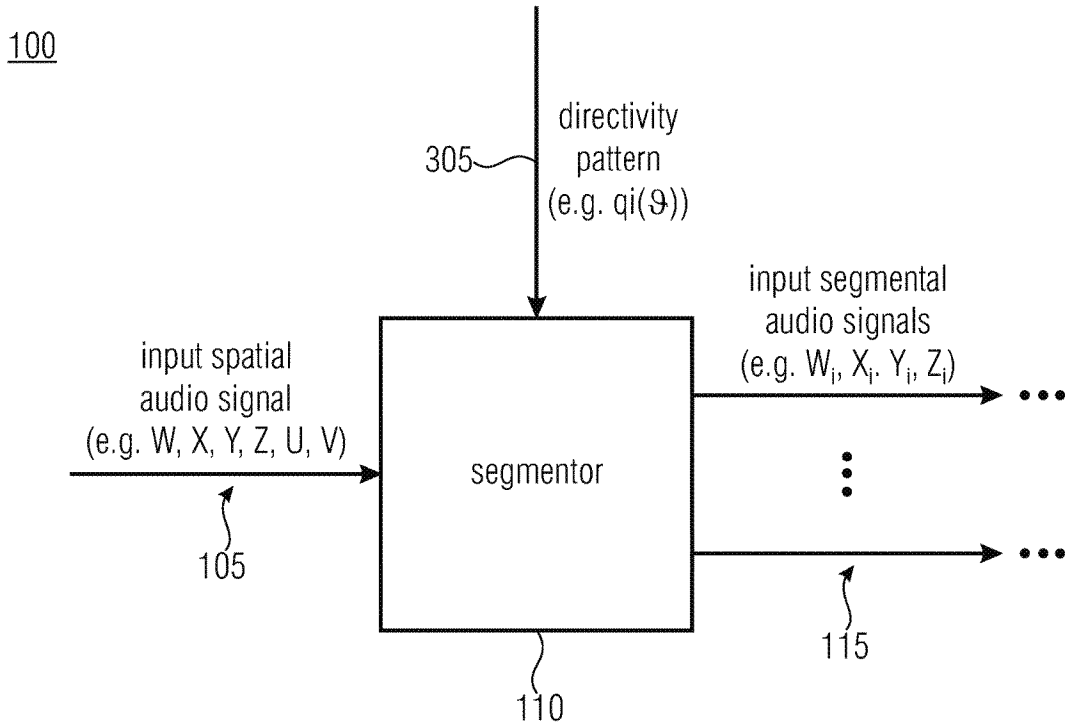
FIG. 3 shows a schematic illustration of the segmentor of the embodiment of the apparatus in accordance with FIG. 1 using a directivity pattern.

FIG. 3 shows a schematic illustration of the segmentor 110 of the embodiment of the apparatus 100 in accordance with FIG. 1 using a (desired or predetermined) directivity pattern 305, $q_i(\vartheta)$. As exemplarily depicted in FIG. 3, the segmentor 110 is configured to use a directivity pattern 305, $q_i(\vartheta)$ for each of the segments $Seg_i$ of the recording space. Furthermore, the directivity pattern 305, $q_i(\vartheta)$, may indicate a directivity of the at least two input segmental audio signals 115 ($W_i$, $X_i$, $Y_i$, $Z_i$).

In embodiments, the directivity pattern 305, $q_i(\vartheta)$, is given by $$q_i(\vartheta)=a+b\cos(\vartheta+\Theta_i) \tag{1}$$

where a and b denote multipliers that can be modified to obtain desired directivity patterns and wherein $\vartheta$ denotes an azimuthal angle and $\Theta_i$ indicates an advantageous direction of the i'th segment of the recording space. For example, a lies in a range of 0 to 1 and b in a range of −1 to 1.

One useful choice of multipliers a, b may be a=0.5 and b=0.5, resulting in the following directivity pattern:

$$q_i(\vartheta)=0.5+0.5\cos(\vartheta+\Theta_i) \tag{1a}$$

By the segmentor 110 exemplarily depicted in FIG. 3, it is possible to obtain the at least two input segmental audio signals 115 ($W_i$, $X_i$, $Y_i$, $Z_i$) associated with the corresponding segments $Seg_i$ of the recording space having a predetermined directivity pattern 305, $q_i(\vartheta)$, respectively. It is pointed out here that the use of the directivity pattern 305, $q_i(\vartheta)$, for each of the segments $Seg_i$ of the recording space allows to enhance the spatial sound quality obtained with the apparatus 100.

Figure 4:
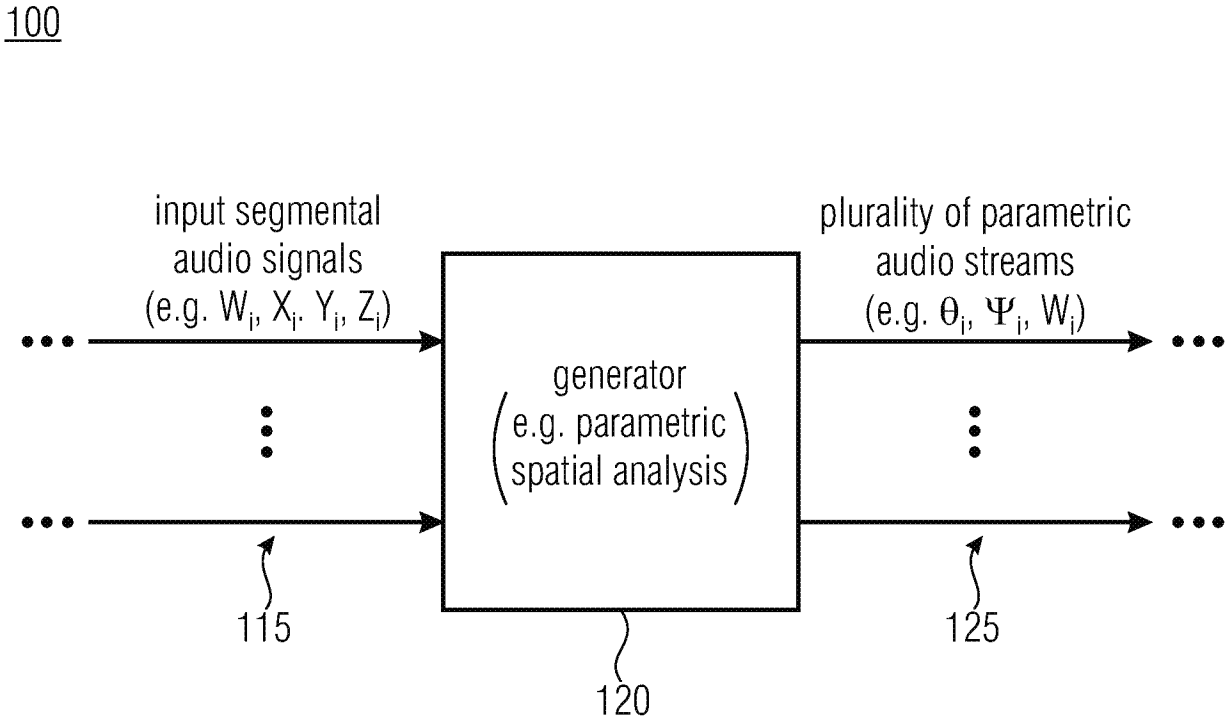
FIG. 4 shows a schematic illustration of the generator of the embodiment of the apparatus in accordance with FIG. 1 based on a parametric spatial analysis.

FIG. 4 shows a schematic illustration of the generator 120 of the embodiment of the apparatus 100 in accordance with FIG. 1 based on a parametric spatial analysis. As exemplarily depicted in FIG. 4, the generator 120 is configured for obtaining the plurality of parametric audio streams 125 ($\theta_i$, $\Psi_i$, $W_i$). Furthermore, the plurality of parametric audio streams 125 ($\theta_i$, $\Psi_i$, $W_i$) may each comprise a component $W_i$ of the at least two input segmental audio signals 115 ($W_i$, $Y_i$, $Z_i$) and a corresponding parametric spatial information $\theta_i$, $\Psi_i$.

In embodiments, the generator 120 may be configured for performing a parametric spatial analysis for each of the at least two input segmental audio signals 115 ($W_i$, $X_i$, $Y_i$, $Z_i$) to obtain the corresponding parametric spatial information $\theta_i$, $\Psi_i$.

In embodiments, the parametric spatial information $\theta_i$, $\Psi_i$ of each of the parametric audio streams 125 ($\theta_i$, $\Psi_i$, $W_i$) comprises a direction-of-arrival (DOA) parameter $\theta_i$ and/or a diffuseness parameter $\Psi_i$.

In embodiments, the direction-of-arrival (DOA) parameter $\theta_i$ and the diffuseness parameter $\Psi_i$ provided by the generator 120 exemplarily depicted in FIG. 4 may constitute DirAC parameters for a parametric spatial audio signal processing. For example, the generator 120 is configured for generating the DirAC parameters (e.g. the DOA parameter $\theta_i$ and the diffuseness parameter $\Psi_i$) using a time-frequency representation of the at least two input segmental audio signals 115.

Figure 5:
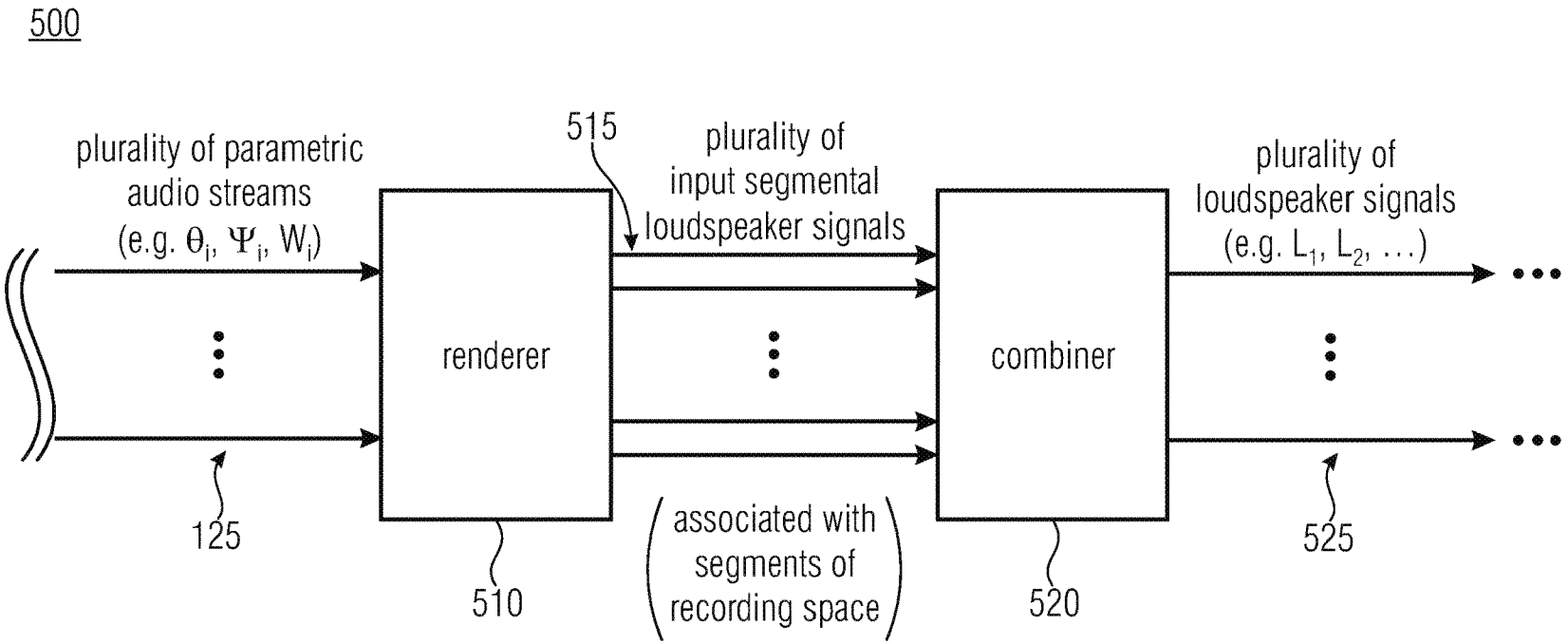
FIG. 5 shows a block diagram of an embodiment of an apparatus for generating a plurality of loudspeaker signals from a plurality of parametric audio streams with a renderer and a combiner.

FIG. 5 shows a block diagram of an embodiment of an apparatus 500 for generating a plurality of loudspeaker signals 525 ($L_1$, $L_2$, . . . ) from a plurality of parametric audio streams 125 ($\theta_i$, $\Psi_i$, $W_i$) with a renderer 510 and a combiner 520. In the embodiment of FIG. 5, the plurality of parametric audio streams 125 ($\theta_i$, $\Psi_i$, $W_i$) may be derived from an input spatial audio signal (e.g. the input spatial audio signal 105 exemplarily depicted in the embodiment of FIG. 1) recorded in a recording space. As shown in FIG. 5, the apparatus 500 comprises a renderer 510 and a combiner 520. For example, the renderer 510 is configured for providing a plurality of input segmental loudspeaker signals 515 from the plurality of parametric audio streams 125 ($\theta_i$, $\Psi_i$, $W_i$), wherein the input segmental loudspeaker signals 515 are associated with corresponding segments ($Seg_i$) of the recording space. Furthermore, the combiner 520 may be configured for combining the input segmental loudspeaker signals 515 to obtain the plurality of loudspeaker signals 525 ($L_1$, $L_2$, . . . ).

By providing the apparatus 500 of FIG. 5, it is possible to generate the plurality of loudspeaker signals 525 ($L_1$, $L_2$, . . . ) from the plurality of parametric audio streams 125 ($\theta_i$, $\Psi_i$, $W_i$), wherein the parametric audio streams 125 ($\theta_i$, $\Psi_i$, $W_i$) may be transmitted from the apparatus 100 of FIG. 1. Furthermore, the apparatus 500 of FIG. 5 allows to achieve a higher quality, more realistic spatial sound reproduction using parametric audio streams derived from relatively simple and compact microphone configurations.

In embodiments, the renderer 510 is configured for receiving the plurality of parametric audio streams 125 ($\theta_i$, $\Psi_i$, $W_i$). For example, the plurality of parametric audio streams 125 ($\theta_i$, $\Psi_i$, $W_i$) each comprise a segmental audio component $W_i$ and a corresponding parametric spatial information $\theta_i$, $\Psi_i$. Furthermore, the renderer 510 may be configured for rendering each of the segmental audio components $W_i$ using the corresponding parametric spatial information 505 ($\theta_i$, $\Psi_i$) to obtain the plurality of input segmental loudspeaker signals 515.

Figure 6:
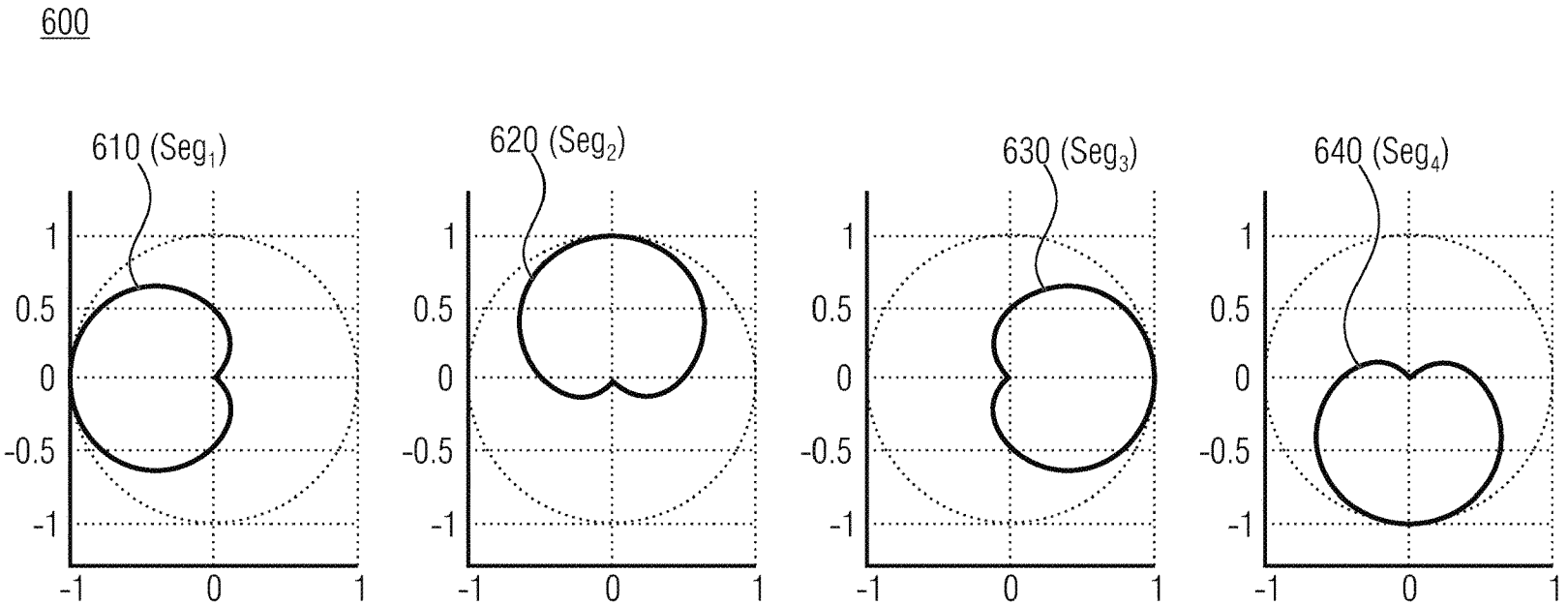
FIG. 6 shows a schematic illustration of example segments of a recording space, each representing a subset of directions within a two-dimensional (2D) plane or within a three-dimensional (3D) space.

FIG. 6 shows a schematic illustration 600 of example segments $Seg_i$ (i=1, 2, 3, 4) 610, 620, 630, 640 of a recording space. In the schematic illustration 600 of FIG. 6, the example segments 610, 620, 630, 640 of the recording space each represent a subset of directions within a two-dimensional (2D) plane. In addition, the segments $Seg_i$ of the recording space may each represent a subset of directions within a three-dimensional (3D) space. For example, the segments $Seg_i$ representing the subsets of directions within the three-dimensional (3D) space can be similar to the segments 610, 620, 630, 640 exemplarily depicted in FIG. 6. According to the schematic illustration 600 of FIG. 6, four example segments 610, 620, 630, 640 for the apparatus 100 of FIG. 1 are exemplarily shown. However, it is also possible to use a different number of segments $Seg_i$ (i=1, 2, . . . , n, wherein i is an integer index, and n denotes the number of segments). The example segments 610, 620, 630, 640 may each be represented in a polar coordinate system (see, e.g. FIG. 6). For the three-dimensional (3D) space, the segments $Seg_i$ may similarly be represented in a spherical coordinate system.

In embodiments, the segmentor 110 exemplarily shown in FIG. 1 may be configured to use the segments $Seg_i$ (e.g. the example segments 610, 620, 630, 640 of FIG. 6) for providing the at least two input segmental audio signals 115 ($W_i$, $X_i$, $Y_i$, $Z_i$). By using the segments (or sectors), it is possible to realize a segment-based (or sector-based) parametric model of the sound field. This enables to achieve a higher quality spatial audio recording and reproduction with a relatively compact microphone configuration.

Figure 7:
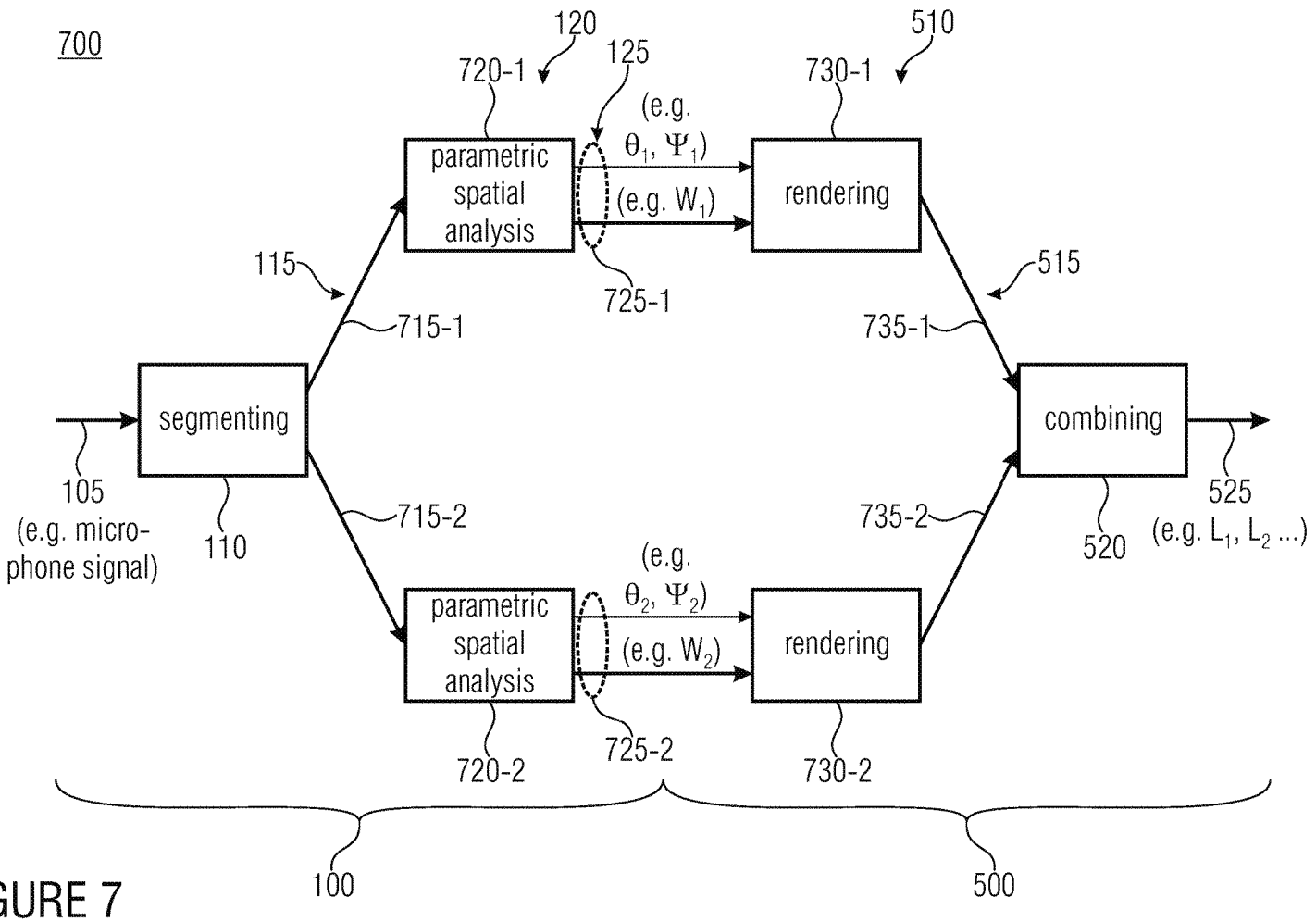
FIG. 7 shows a schematic illustration of an example loudspeaker signal computation for two segments or sectors of a recording space.

FIG. 7 shows a schematic illustration 700 of an example loudspeaker signal computation for two segments or sectors of a recording space. In the schematic illustration 700 of FIG. 7, the embodiment of the apparatus 100 for generating the plurality of parametric audio streams 125 ($\theta_i$, $\Psi_i$, $W_i$) and the embodiment of the apparatus 500 for generating the plurality of loudspeaker signals 525 ($L_1$, $L_2$, . . . ) are exemplarily depicted. As shown in the schematic illustration 700 of FIG. 7, the segmentor 110 may be configured for receiving the input spatial audio signal 105 (e.g. microphone signal). Furthermore, the segmentor 110 may be configured for providing the at least two input segmental audio signals 115 (e.g. segmental microphone signals 715-1 of a first segment and segmental microphone signals 715-2 of a second segment). The generator 120 may comprise a first parametric spatial analysis block 720-1 and a second parametric spatial analysis block 720-2. Furthermore, the generator 120 may be configured for generating the parametric audio stream for each of the at least two input segmental audio signals 115. At the output of the embodiment of the apparatus 100, the plurality of parametric audio streams 125 will be obtained. For example, the first parametric spatial analysis block 720-1 will output a first parametric audio stream 725-1 of a first segment, while the second parametric spatial analysis block 720-2 will output a second parametric audio stream 725-2 of a second segment. Furthermore, the first parametric audio stream 725-1 provided by the first parametric spatial analysis block 720-1 may comprise parametric spatial information (e.g. $\theta_1$, $\Psi_1$) of a first segment and one or more segmental audio signals (e.g. $W_1$) of the first segment, while the second parametric audio stream 725-2 provided by the second parametric spatial analysis block 720-2 may comprise parametric spatial information (e.g. $\vartheta_2$, $\Psi_2$) of a second segment and one or more segmental audio signals (e.g. $W_2$) of the second segment. The embodiment of the apparatus 100 may be configured for transmitting the plurality of parametric audio streams 125. As also shown in the schematic illustration 700 of FIG. 7, the embodiment of the apparatus 500 may be configured for receiving the plurality of parametric audio streams 125 from the embodiment of the apparatus 100. The renderer 510 may comprise a first rendering unit 730-1 and a second rendering unit 730-2. Furthermore, the renderer 510 may be configured for providing the plurality of input segmental loudspeaker signals 515 from the received plurality of parametric audio streams 125. For example, the first rendering unit 730-1 may be configured for providing input segmental loudspeaker signals 735-1 of a first segment from the first parametric audio stream 725-1 of the first segment, while the second rendering unit 730-2 may be configured for providing input segmental loudspeaker signals 735-2 of a second segment from the second parametric audio stream 725-2 of the second segment. Furthermore, the combiner 520 may be configured for combining the input segmental loudspeaker signals 515 to obtain the plurality of loudspeaker signals 525 (e.g. $L_1$, $L_2$, . . . ).

The embodiment of FIG. 7 essentially represents a higher quality spatial audio recording and reproduction concept using a segment-based (or sector-based) parametric model of the sound field, which allows to record also complex spatial audio scenes with a relatively compact microphone configuration.

Figure 8:
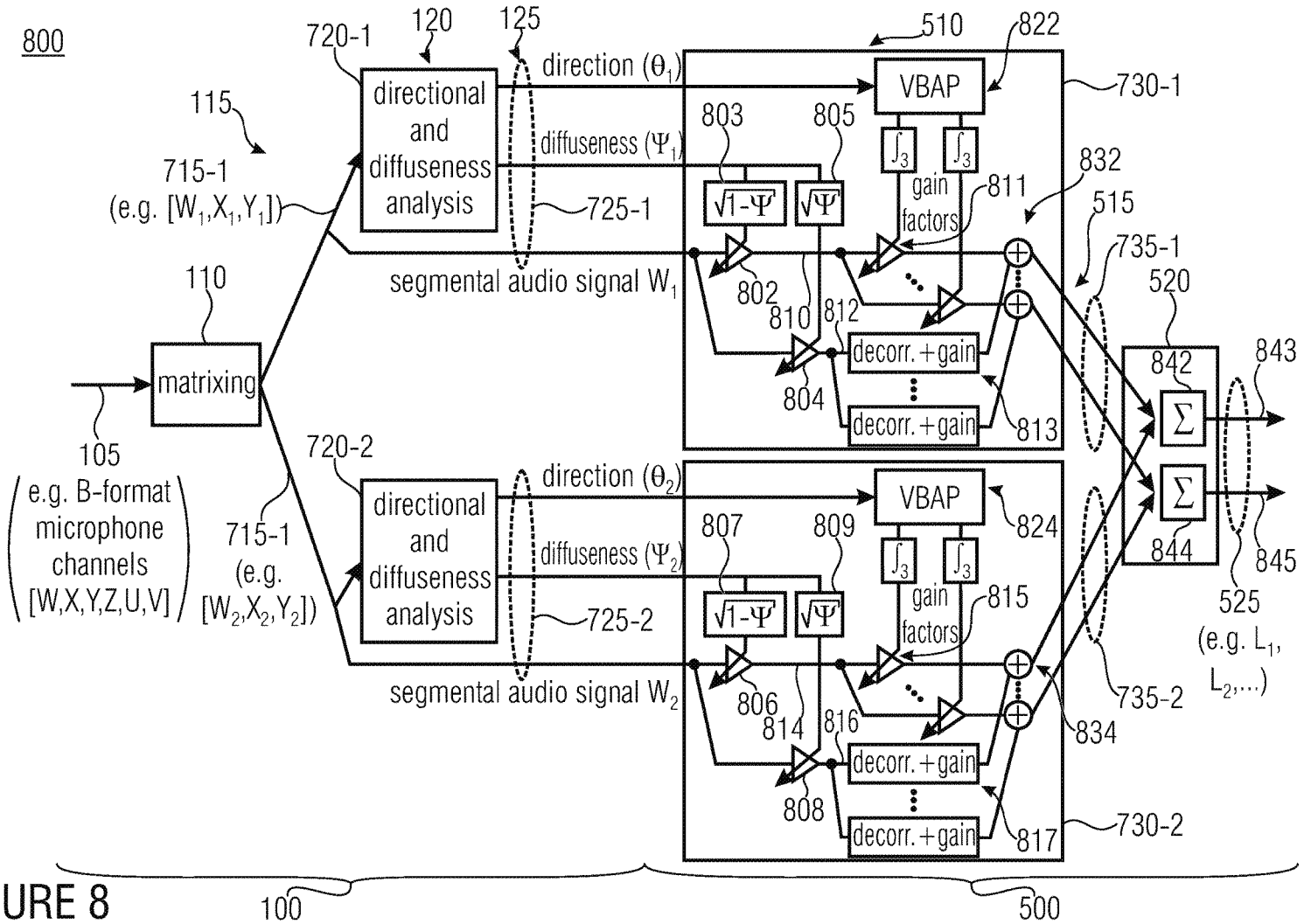
FIG. 8 shows a schematic illustration of an example loudspeaker signal computation for two segments or sectors of a recording space using second order B-format input signals.

FIG. 8 shows a schematic illustration 800 of an example loudspeaker signal computation for two segments or sectors of a recording space using second order B-format input signals 105. The example loudspeaker signal computation schematically illustrated in FIG. 8 essentially corresponds to the example loudspeaker signal computation schematically illustrated in FIG. 7. In the schematic illustration of FIG. 8, the embodiment of the apparatus 100 for generating the plurality of parametric audio streams 125 and the embodiment of the apparatus 500 for generating the plurality of loudspeaker signals 525 are exemplarily depicted. As shown in FIG. 8, the embodiment of the apparatus 100 may be configured for receiving the input spatial audio signal 105 (e.g. B-format microphone channels such as [W, X, Y, U, V]). Here, it is to be noted that the signals U, V in FIG. 8 are second order B-format components. The segmentor 110 exemplarily denoted by "matrixing" may be configured for generating the at least two input segmental audio signals 115 from the omnidirectional signal and the plurality of different directional signals using a mixing or matrixing operation which depends on the segments $Seg_i$ of the recording space. For example, the at least two input segmental audio signals 115 may comprise the segmental microphone signal 715-1 of a first segment (e.g. [$W_1$, $X_1$, $Y_1$]) and the segmental microphone signals 715-2 of a second segment (e.g. [$W_2$, $X_2$, $Y_2$]). Furthermore, the generator 120 may comprise a first directional and diffuseness analysis block 720-1 and a second directional and diffuseness analysis block 720-2. The first and the second directional and diffuseness analysis blocks 720-1, 720-2 exemplarily shown in FIG. 8 essentially correspond to the first and the second parametric spatial analysis blocks 720-1, 720-2 exemplarily shown in FIG. 7. The generator 120 may be configured for generating a parametric audio stream for each of the at least two input segmental audio signals 115 to obtain the plurality of parametric audio streams 125. For example, the generator 120 may be configured for performing a spatial analysis on the segmental microphone signals 715-1 of the first segment using the first directional and diffuseness analysis block 720-1 and for extracting a first component (e.g. a segmental audio signal $W_1$) from the segmental microphone signals 715-1 of the first segment to obtain the first parametric audio stream 725-1 of the first segment. Furthermore, the generator 120 may be configured for performing a spatial analysis on the segmental microphone signals 715-2 of the second segment and for extracting a second component (e.g. a segmental audio signal $W_2$) from the segmental microphone signals 715-2 of the second segment using the second directional and diffuseness analysis block 720-2 to obtain the second parametric audio stream 725-2 of the second segment. For example, the first parametric audio stream 725-1 of the first segment may comprise parametric spatial information of the first segment comprising a first direction-of-arrival (DOA) parameter $\theta_1$ and a first diffuseness parameter $\Psi_1$ as well as a first extracted component $W_i$, while the second parametric audio stream 725-2 of the second segment may comprise parametric spatial information of the second segment comprising a second direction-of-arrival (DOA) parameter $\vartheta_2$ and a second diffuseness parameter $\Psi_2$ as well as a second extracted component $W_2$. The embodiment of the apparatus 100 may be configured for transmitting the plurality of parametric audio streams 125.

As also shown in the schematic illustration 800 of FIG. 8, the embodiment of the apparatus 500 for generating the plurality of loudspeaker signals 525 may be configured for receiving the plurality of parametric audio streams 125 transmitted from the embodiment of the apparatus 100. In the schematic illustration 800 of FIG. 8, the renderer 510 comprises the first rendering unit 730-1 and the second rendering unit 730-2. For example, the first rendering unit 730-1 comprises a first multiplier 802 and a second multiplier 804. The first multiplier 802 of the first rendering unit 730-1 may be configured for applying a first weighting factor 803 (e.g.) $\sqrt{1-\Psi}$) to the segmental audio signal $W_i$ of the first parametric audio stream 725-1 of the first segment to obtain a direct sound substream 810 by the first rendering unit 730-1, while the second multiplier 804 of the first rendering unit 730-1 may be configured for applying a second weighting factor 805 (e.g. $\sqrt{\Psi}$) to the segmental audio signal $W_i$ of the first parametric audio stream 725-1 of the first segment to obtain a diffuse substream 812 by the first rendering unit 730-1. Furthermore, the second rendering unit 730-2 may comprise a first multiplier 806 and a second multiplier 808. For example, the first multiplier 806 of the second rendering unit 730-2 may be configured for applying a first weighting factor 807 (e.g. $\sqrt{1-\Psi}$) to the segmental audio signal $W_2$ of the second parametric audio stream 725-2 of the second segment to obtain a direct sound stream 814 by the second rendering unit 730-2, while the second multiplier 808 of the second rendering unit 730-2 may be configured for applying a second weighting factor 809 (e.g. $\sqrt{\Psi}$) to the segmental audio signal $W_2$ of the second parametric audio stream 725-2 of the second segment to obtain a diffuse substream 816 by the second rendering unit 730-2. In embodiments, the first and the second weighting factors 803, 805, 807, 809 of the first and the second rendering units 730-1, 730-2 are derived from the corresponding diffuseness parameters $\Psi_i$. According to embodiments, the first rendering unit 730-1 may comprise gain factor multipliers 811, decorrelating processing blocks 813 and combining units 832, while the second rendering unit 730-2 may comprise gain factor multipliers 815, decorrelating processing blocks 817 and combining units 834. For example, the gain factor multipliers 811 of the first rendering unit 730-1 may be configured for applying gain factors obtained from a vector base amplitude panning (VBAP) operation by blocks 822 to the direct sound substream 810 output by the first multiplier 802 of the first rendering unit 730-1. Furthermore, the decorrelating processing blocks 813 of the first rendering unit 730-1 may be configured for applying a decorrelation/gain operation to the diffuse substream 812 at the output of the second multiplier 804 of the first rendering unit 730-1. In addition, the combining units 832 of the first rendering unit 730-1 may be configured for combining the signals obtained from the gain factor multipliers 811 and the decorrelating processing blocks 813 to obtain the segmental loudspeaker signals 735-1 of the first segment. For example, the gain factor multipliers 815 of the second rendering unit 730-2 may be configured for applying gain factors obtained from a vector base amplitude panning (VBAP) operation by blocks 824 to the direct sound substream 814 output by the first multiplier 806 of the second rendering unit 730-2. Furthermore, the decorrelating processing blocks 817 of the second rendering unit 730-2 may be configured for applying a decorrelation/gain operation to the diffuse substream 816 at the output of the second multiplier 808 of the second rendering unit 730-2. In addition, the combining units 834 of the second rendering unit 730-2 may be configured for combining the signals obtained from the gain factor multipliers 815 and the decorrelating processing blocks 817 to obtain the segmental loudspeaker signals 735-2 of the second segment.

In embodiments, the vector base amplitude panning (VBAP) operation by blocks 822, 824 of the first and the second rendering unit 730-1, 730-2 depends on the corresponding direction-of-arrival (DOA) parameters $\theta_i$. As exemplarily depicted in FIG. 8, the combiner 520 may be configured for combining the input segmental loudspeaker signals 515 to obtain the plurality of loudspeaker signals 525 (e.g. $L_1$, $L_2$, . . . ). As exemplarily depicted in FIG. 8, the combiner 520 may comprise a first summing up unit 842 and a second summing up unit 844. For example, the first summing up unit 842 is configured to sum up a first of the segmental loudspeaker signals 735-1 of the first segment and a first of the segmental loudspeaker signals 735-2 of the second segment to obtain a first loudspeaker signal 843. In addition, the second summing up unit 844 may be configured to sum up a second of the segmental loudspeaker signals 735-1 of the first segment and a second of the segmental loudspeaker signals 735-2 of the second segment to obtain a second loudspeaker signal 845. The first and the second loudspeaker signals 843, 845 may constitute the plurality of loudspeaker signals 525. Referring to the embodiment of FIG. 8, it should be noted that for each segment, potentially loudspeaker signals for all loudspeakers of the playback can be generated.

Figure 9:
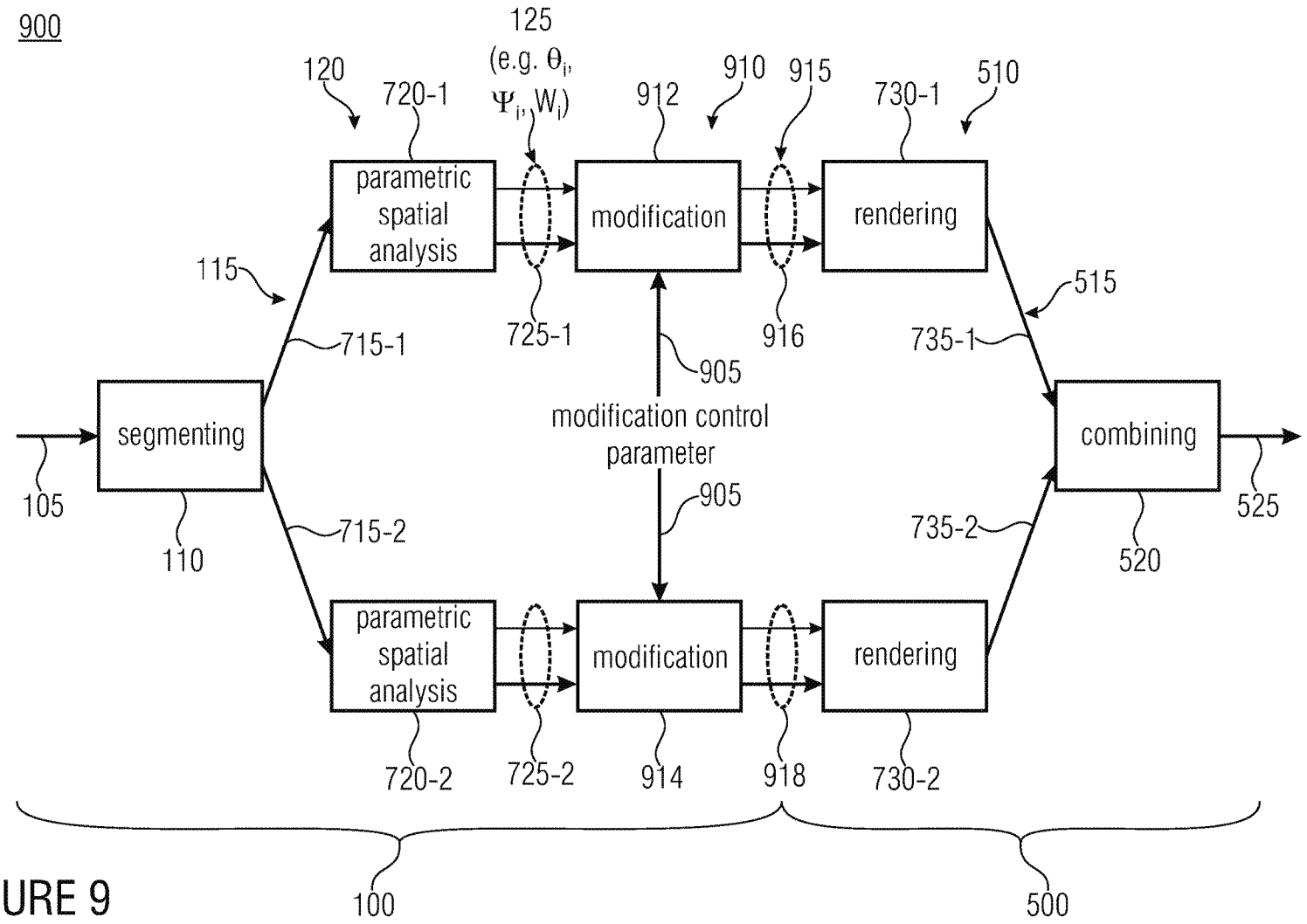
FIG. 9 shows a schematic illustration of an example loudspeaker signal computation for two segments or sectors of a recording space including a signal modification in a parametric signal representation domain.

FIG. 9 shows a schematic illustration 900 of an example loudspeaker signal computation for two segments or sectors of a recording space including a signal modification in a parametric signal representation domain. The example loudspeaker signal computation in the schematic illustration 900 of FIG. 9 essentially corresponds to the example loudspeaker signal computation in the schematic illustration 700 of FIG. 7. However, the example loudspeaker signal computation in the schematic illustration 900 of FIG. 9 includes an additional signal modification.

In the schematic illustration 900 of FIG. 9, the apparatus 100 comprises the segmentor 110 and the generator 120 for obtaining the plurality of parametric audio streams 125 ($\theta_i$, $\Psi_i$, $W_i$). Furthermore, the apparatus 500 comprises the renderer 510 and the combiner 520 for obtaining the plurality of loudspeaker signals 525.

For example, the apparatus 100 may further comprise a modifier 910 for modifying the plurality of parametric audio streams 125 ($\theta_i$, $\Psi_i$, $W_i$) in a parametric signal representation domain. Furthermore, the modifier 910 may be configured to modify at least one of the parametric audio streams 125 ($\theta_i$, $\Psi_i$, $W_i$) using a corresponding modification control parameter 905. In this way, a first modified parametric audio stream 916 of a first segment and a second modified parametric audio stream 918 of a second segment may be obtained. The first and the second modified parametric audio streams 916, 918 may constitute a plurality of modified parametric audio streams 915. In embodiments, the apparatus 100 may be configured for transmitting the plurality of modified parametric audio streams 915. In addition, the apparatus 500 may be configured for receiving the plurality of modified parametric audio streams 915 transmitted from the apparatus 100.

By providing the example loudspeaker signal computation according to FIG. 9, it is possible to achieve a more flexible spatial audio recording and reproduction scheme. In particular, it is possible to obtain higher quality output signals when applying modifications in the parametric domain. By segmenting the input signals before generating the plurality of parametric audio representations (streams), a higher spatial selectivity is obtained that better allows to treat different components of the captured sound field differently.

Figure 10:
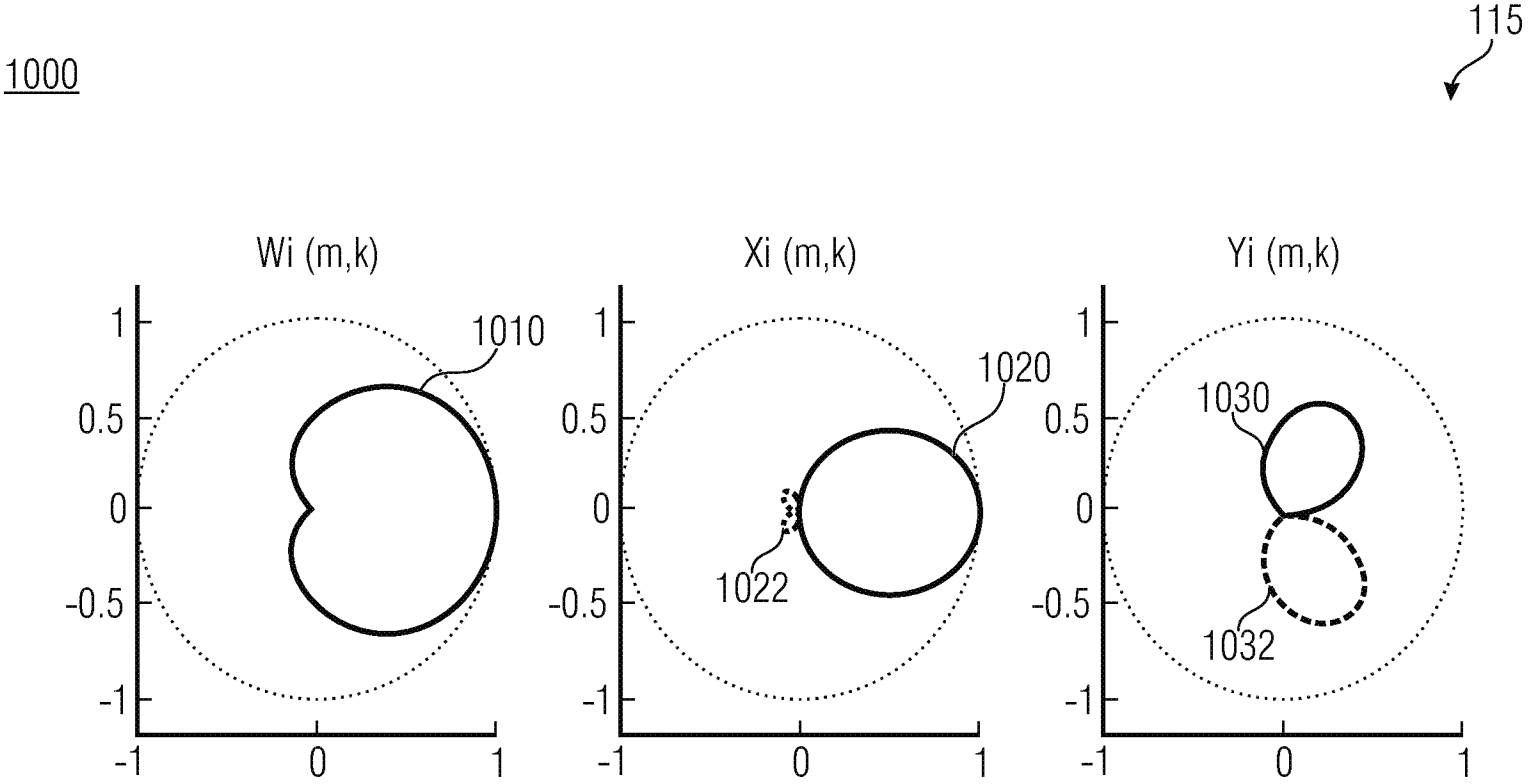
FIG. 10 shows a schematic illustration of example polar patterns of input segmental audio signals provided by the segmentor of the embodiment of the apparatus in accordance with FIG. 1.

FIG. 10 shows a schematic illustration 1000 of example polar patterns of input segmental audio signals 115 (e.g. $W_i$, $X_i$, $Y_i$) provided by the segmentor 110 of the embodiment of the apparatus 100 for generating the plurality of parametric audio streams 125 ($\theta_i$, $\Psi_i$, $W_i$) in accordance with FIG. 1. In the schematic illustration 1000 of FIG. 10, the example input segmental audio signals 115 are visualized in a respective polar coordinate system for the two-dimensional (2D) plane. Similarly, the example input segmental audio signals 115 can be visualized in a respective spherical coordinate system for the three-dimensional (3D) space. The schematic illustration 1000 of FIG. 10 exemplarily depicts a first directional response 1010 for a first input segmental audio signal (e.g. an omnidirectional signal $W_i$), a second directional response 1020 of a second input segmental audio signal (e.g. a first directional signal $X_i$) and a third directional response 1030 of a third input segmental audio signal (e.g. a second directional signal $Y_i$). Furthermore, a fourth directional response 1022 with opposite sign compared to the second directional response 1020 and a fifth directional response 1032 with opposite sign compared to the third directional response 1030 are exemplarily depicted in the schematic illustration 1000 of FIG. 10. Thus, different directional responses 1010, 1020, 1030, 1022, 1032 (polar patterns) can be used for the input segmental audio signals 115 by the segmentor 110. It is pointed out here that the input segmental audio signals 115 can be dependent on time and frequency, i.e. $W_i=W_i(m, k)$, $X_i=X_i(m, k)$, and $Y_i=Y_i(m, k)$, wherein (m, k) are indices indicating a time-frequency tile in a spatial audio signal representation.

In this context, it should be noted that FIG. 10 exemplarily depicts the polar diagrams for a single set of input signals, i.e. the signals 115 for a single sector i (e.g. [$W_i$, $X_i$, $Y_i$]). Furthermore, the positive and negative parts of the polar diagram plots together represent the polar diagram of a signal, respectively (for example, the parts 1020 and 1022 together show the polar diagram of signal $X_i$, while the parts 1030 and 1032 together show the polar diagram of signal $Y_i$.).

Figure 11:
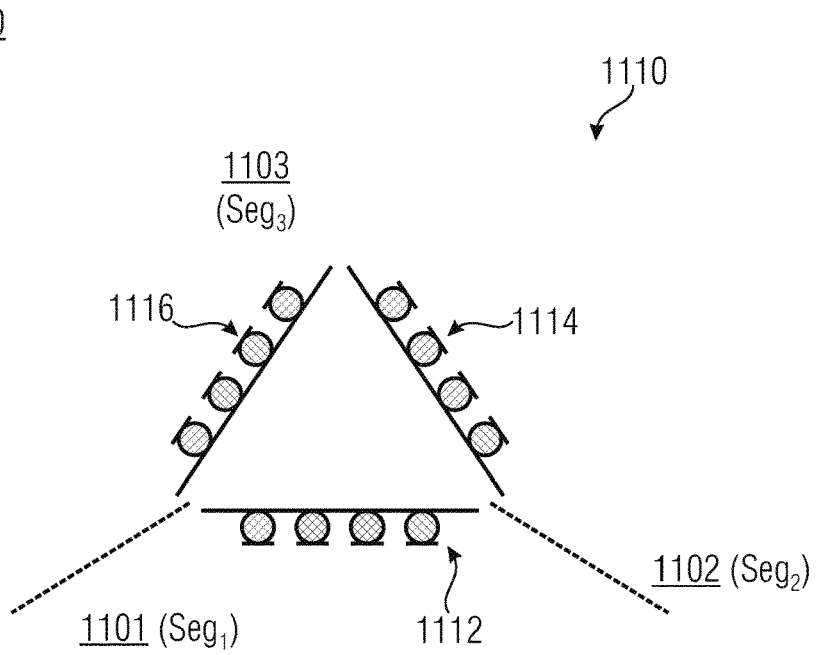
FIG. 11 shows a schematic illustration of an example microphone configuration for performing a sound field recording.

FIG. 11 shows a schematic illustration 1100 of an example microphone configuration 1110 for performing a sound field recording. In the schematic illustration 1100 of FIG. 11, the microphone configuration 1110 may comprise multiple linear arrays of directional microphones 1112, 1114, 1116. The schematic illustration 1100 of FIG. 11 exemplarily depicts how a two-dimensional (2D) observation space can be divided into different segments or sectors 1101, 1102, 1103 (e.g. $Seg_i$, i=1, 2. 3) of the recording space. Here, the segments 1101, 1102, 1103 of FIG. 11 may correspond to the segments $Seg_i$ exemplarily depicted in FIG. 6. Similarly, the example microphone configuration 1110 can also be used in the three-dimensional (3D) observation space, wherein the three-dimensional (3D) observation space can be divided into the segments or sectors for the given microphone configuration. In embodiments, the example microphone configuration 1110 in the schematic illustration 1100 of FIG. 11 can be used to provide the input spatial audio signal 105 for the embodiment of the apparatus 100 in accordance with FIG. 1. For example, the multiple linear arrays of directional microphones 1112, 1114, 1116 of the microphone configuration 1110 may be configured to provide the different directional signals for the input spatial audio signal 105. By the use of the example microphone configuration 1110 of FIG. 11, it is possible to optimize the spatial audio recording quality using the segment-based (or sector-based) parametric model of the sound field.

In the previous embodiments, the apparatus 100 and the apparatus 500 may be configured to be operative in the time-frequency domain.

In summary, embodiments of the present invention relate to the field of high quality spatial audio recording and reproduction. The use of a segment-based or sector-based parametric model of the sound field allows to also record complex spatial audio scenes with relatively compact microphone configurations. In contrast to a simple global model of the sound field assumed by the current state of the art methods, the parametric information can be determined for a number of segments in which the entire observation space is divided. Therefore, the rendering for an almost arbitrary loudspeaker configuration can be performed based on the parametric information together with the recorded audio channels.

According to embodiments, for a planar two-dimensional (2D) sound field recording, the entire azimuthal angle range of interest can be divided into multiple sectors or segments covering a reduced range of azimuthal angles. Analogously, in the 3D case the full solid angle range (azimuthal and elevation) can be divided into sectors or segments covering a smaller angle range. The different sectors or segments may also partially overlap.

According to embodiments, each sector or segment is characterized by an associated directional measure, which can be used to specify or refer to the corresponding sector or segment. The directional measure can, for example, be a vector pointing to (or from) the center of the sector or segment, or an azimuthal angle in the 2D case, or a set of an azimuth and an elevation angle in the 3D case. The segment or sector can be referred to as both a subset of directions within a 2D plane or within a 3D space. For presentational simplicity, the previous examples were exemplarily described for the 2D case; however the extension to 3D configurations is straightforward.

With reference to FIG. 6, the directional measure may be defined as a vector which, for the segment $Seg_3$, points from the origin, i.e. the center with the coordinate (0, 0), to the right, i.e. towards the coordinate (1, 0) in the polar diagram, or the azimuthal angle of 0° if, in FIG. 6, angles are counted from (or referred to) the x-axis (horizontal axis).

Referring to the embodiment of FIG. 1, the apparatus 100 may be configured to receive a number of microphone signals as an input (input spatial audio signal 105). These microphone signals can, for example, either result from a real recording or can be artificially generated by a simulated recording in a virtual environment. From these microphone signals, corresponding segmental microphone signals (input segmental audio signals 115) can be determined, which are associated with the corresponding segments ($Seg_i$). The segmental microphone signals feature specific characteristics. Their directional pick-up pattern may show a significantly increased sensitivity within the associated angular sector compared to the sensitivity outside this sector. An example of the segmentation of a full azimuth range of 360° and the pick-up patterns of the associated segmental microphone signals were illustrated with reference to FIG. 6. In the example of FIG. 6, the directivity of the microphones associated with the sectors exhibit cardioid patterns which are rotated in accordance to the angular range covered by the corresponding sector. For example, the directivity of the microphone associated with the sector 3 ($Seg_3$) pointing towards 0° is also pointing towards 0°. Here, it should be noted that in the polar diagrams of FIG. 6, the direction of the maximum sensitivity is the direction in which the radius of the depicted curve comprises the maximum. Thus, $Seg_3$ has the highest sensitivity for sound components which come from the right. In other words, the segment $Seg_3$ has its advantageous direction at the azimuthal angle of 0° (assuming that angles are counted from the x-axis).

According to embodiments, for each sector, a DOA parameter ($\theta_i$) can be determined together with a sector-based diffuseness parameter ($\Psi_i$). In a simple realization, the diffuseness parameter ($\Psi_i$) may be the same for all sectors. In principle, any advantageous DOA estimation algorithm can be applied (e.g. by the generator 120). For example, the DOA parameter ($\theta_i$) can be interpreted to reflect the opposite direction in which most of the sound energy is traveling within the considered sector. Accordingly, the sector-based diffuseness relates to the ratio of the diffuse sound energy and the total sound energy within the considered sector. It is to be noted that the parameter estimation (such as performed with the generator 120) can be performed time-variantly and individually for each frequency band.

According to embodiments, for each sector, a directional audio stream (parametric audio stream) can be composed including the segmental microphone signal ($W_i$) and the sector-based DOA and diffuseness parameters ($\theta_i$, $\Psi_i$) which predominantly describe the spatial audio properties of the sound field within the angular range represented by that sector. For example, the loudspeaker signals 525 for playback can be determined using the parametric directional information ($\theta_i$, $\Psi_i$) and one or more of the segmental microphone signals 125 (e.g. $W_i$). Thereby, a set of segmental loudspeaker signals 515 can be determined for each segment which can then be combined such as by the combiner 520 (e.g. summed up or mixed) to build the final loudspeaker signals 525 for playback. The direct sound components within a sector can, for example, be rendered as point-like sources by applying an example vector base amplitude panning (as described in V. Pulkki: Virtual sound source positioning using Vector Base Amplitude Panning J. Audio Eng. Soc., Vol. 45, pp. 456-466, 1997), whereas the diffuse sound can be played back from several loudspeakers at the same time.

The block diagram in FIG. 7 illustrates the computation of the loudspeaker signals 525 as described above for the case of two sectors. In FIG. 7, bold arrows represent audio signals, whereas thin arrows represent parametric signals or control signals. In FIG. 7, the generation of the segmental microphone signals 115 by the segmentor 110, the application of the parametric spatial signal analysis (blocks 720-1, 720-1) for each sector (e.g. by the generator 120), the generation of the segmental loudspeaker signals 515 by the renderer 510 and the combining of the segmental loudspeaker signals 515 by the combiner 520 are schematically illustrated.

In embodiments, the segmentor 110 may be configured for performing the generation of the segmental microphone signals 115 from a set of microphone input signals 105.

Furthermore, the generator 120 may be configured for performing the application of the parametric spatial signal analysis for each sector such that the parametric audio streams 725-1, 725-2 for each sector will be obtained. For example, each of the parametric audio streams 725-1, 725-2 may consist of at least one segmental audio signal (e.g. $W_1$, $W_2$, respectively) as well as associated parametric information (e.g. DOA parameters $\theta_1$, $\theta_2$ and diffuseness parameters $\Psi_1$, $\Psi_2$, respectively). The renderer 510 may be configured for performing the generation of the segmental loudspeaker signals 515 for each sector based on the parametric audio streams 725-1, 725-2 generated for the particular sectors. The combiner 520 may be configured for performing the combining of the segmental loudspeaker signals 515 to obtain the final loudspeaker signals 525.

The block diagram in FIG. 8 illustrates the computation of the loudspeaker signals 525 for the example case of two sectors shown as an example for a second order B-format microphone signal application. As shown in the embodiment of FIG. 8, two (sets of) segmental microphone signals 715-1 (e.g. [$W_1$, $X_1$, $Y_1$]) and 715-2 (e.g. [$W_2$, $X_2$, $Y_2$]) can be generated from a set of input microphone signals 105 by a mixing or matrixing operation (e.g. by block 110) as described before. For each of the two segmental microphone signals, a directional audio analysis (e.g. by blocks 720-1, 720-2) can be performed, yielding the directional audio streams 725-1 (e.g. $\theta_1$, $\Psi_1$, $W_1$) and 725-2 (e.g. $\vartheta_2$, $\Psi_2$, $W_2$) for the first sector and the second sector, respectively.

In FIG. 8, the segmental loudspeaker signals 515 can be generated separately for each sector as follows. The segmental audio component $W_i$ can be divided into two complementary substreams 810, 812, 814, 816 by weighting with multipliers 803, 805, 807, 809 derived from the diffuseness parameter $\Psi_i$. One substream may carry predominately direct sound components, whereas the other substream may carry predominately diffuse sound components. The direct sound substreams 810, 814 can be rendered using panning gains 811, 815 determined by the DOA parameter $\theta_i$, whereas the diffuse substreams 812, 816 can be rendered incoherently using decorrelating processing blocks 813, 817.

As an example last step, the segmental loudspeaker signals 515 can be combined (e.g. by block 520) to obtain the final output signals 525 for loudspeaker reproduction.

Referring to the embodiment of FIG. 9, it should be mentioned that the estimated parameters (within the parametric audio streams 125) may also be modified (e.g. by modifier 910) before the actual loudspeaker signals 525 for playback are determined. For example, the DOA parameter $\theta_i$ may be remapped to achieve a manipulation of the sound scene. In other cases, the audio signals (e.g. $W_i$) of certain sectors may be attenuated before computing the loudspeaker signals 525 if the sound coming from a certain or all directions included in these sectors are not desired. Analogously, diffuse sound components can be attenuated if mainly or only direct sound should be rendered. This processing including a modification 910 of the parametric audio streams 125 is exemplarily illustrated in FIG. 9 for the example of a segmentation into two segments.

An embodiment of a sector-based parameter estimation in the example 2D case performed with the previous embodiments will be described in the following. It is assumed that the microphone signals used for capturing can be converted into so-called second-order B-format signals. Second-order B-format signals can be described by the shape of the directivity patterns of the corresponding microphones:

$$b_W(\vartheta)=1 \tag{2}$$

$$b_X(\vartheta)=\cos(\vartheta) \tag{3}$$

$$b_Y(\vartheta)=\sin(\vartheta) \tag{4}$$

$$b_U(\vartheta)=\cos(2\vartheta) \tag{5}$$

$$b_Y(\vartheta)=\sin(2\vartheta) \tag{6}$$

where $\vartheta$ denotes the azimuth angle. The corresponding B-format signals (e.g. input 105 of FIG. 8) are denoted by W(m, k), X(m, k), Y(m, k), U(m, k) and V(m, k), where m and k represent a time and frequency index, respectively. It is now assumed that the segmental microphone signal associated with the i'th sector has a directivity pattern $q_i(\vartheta)$. We can then determine (e.g. by block 110) the additional microphone signals 115, $W_i(m, k)$, $X_i(m, k)$, $Y_i(m, k)$ having a directivity pattern which can be expressed by $$b_{W_i}(\vartheta)=q_i(\vartheta) \tag{7}$$

$$b_{X_i}(\vartheta)=q_i(\vartheta)\cos(\vartheta) \tag{8}$$

$$b_{Y_i}(\vartheta)=q_i(\vartheta)\sin(\vartheta) \tag{9}$$

Some examples for the directivity patterns of the described microphone signals in case of an example cardioid pattern $q_i(\vartheta)=0.5+0.5\cos(\vartheta+\Theta_i)$ are shown in FIG. 10. The advantageous direction of the i'th sector depends on an azimuth angle $\Theta_i$. In FIG. 10, the dashed lines indicate the directional responses 1022, 1032 (polar patterns) with opposite sign compared to the directional responses 1020, 1030 depicted with solid lines.

Note that for the example case of $\Theta_i=0$, the signals $W_i(m, k)$, $X_i(m, k)$, $Y_i(m, k)$ can be determined from the second-order B-format signals by mixing the input components W, X, Y, U, V according to $$W_i(m,k)=0.5W(m,k)+0.5X(m,k) \tag{10}$$

$$X_i(m,k)=0.25W(m,k)+0.5X(m,k)+0.25U(m,k) \tag{11}$$

$$Y_i(m,k)=0.5Y(m,k)+0.25V(m,k) \tag{12}$$

This mixing operation is performed e.g. in FIG. 2 in building block 110. Note that a different choice of $q_i(\vartheta)$ leads to a different mixing rule to obtain the components $W_i$, $X_i$, $Y_i$ from the second-order B-format signals.

From the segmental microphone signals 115, $W_i(m, k)$, $X_i(m, k)$, $Y_i(m, k)$, we can then determine (e.g. by block 120) the DOA parameter $\theta_i$ associated with the i'th sector by computing the sector-based active intensity vector $$I_{a_i}(m,k)=-\frac{1}{2\rho_0 c}\mathrm{Re}\left\{W_i^*(m,k)\cdot\begin{bmatrix}X_i(m,k)\\Y_i(m,k)\end{bmatrix}\right\} \tag{13}$$

where Re {A} denotes the real part of the complex number A and * denotes complex conjugate. Furthermore, $\rho_0$ is the air density and c is the sound velocity. The desired DOA estimate $\theta_i(m, k)$, for example represented by the unit vector $e_i(m, k)$, can be obtained by $$e_i(m,k)=-\frac{I_{a_i}(m,k)}{\|I_{a_i}(m,k)\|} \tag{14}$$

We can further determine the sector-based, sound field energy related quantity $$E_i(m,k) = \frac{1}{4\rho_0 c^2}(|W_i(m,k)|^2 + |X_i(m,k)|^2 + |Y_i(m,k)|^2) \quad (15)$$

The desired diffuseness parameter $\Psi_i(m, k)$ of the i'th sector can then be determined by $$\Psi_i(m,k) = g\left(1 - \frac{\|E\{I_{a_i}(m,k)\}\|}{cE_i(m,k)}\right) \quad (16)$$

where g denotes a suitable scaling factor, E{ } is the expectation operator and || || denotes the vector norm. It can be shown that the diffuseness parameter $\Psi_i(m, k)$ is zero if only a plane wave is present and takes a positive value smaller than or equal to one in the case of purely diffuse sound fields. In general, an alternative mapping function can be defined for the diffuseness which exhibits a similar behavior, i.e. giving 0 for direct sound only, and approaching 1 for a completely diffuse sound field.

Referring to the embodiment of FIG. 11, an alternative realization for the parameter estimation can be used for different microphone configurations. As exemplarily illustrated in FIG. 11, multiple linear arrays 1112, 1114, 1116 of directional microphones can be used. FIG. 11 also shows an example of how the 2D observation space can be divided into sectors 1101, 1102, 1103 for the given microphone configuration. The segmental microphone signals 115 can be determined by beam forming techniques such as filter and sum beam forming applied to each of the linear microphone arrays 1112, 1114, 1116. The beamforming may also be omitted, i.e. the directional patterns of the directional microphones may be used as the only means to obtain segmental microphone signals 115 that show the desired spatial selectivity for each sector ($Seg_i$). The DOA parameter $\theta_i$ within each sector can be estimated using common estimation techniques such as the "ESPRIT" algorithm (as described in R. Roy and T. Kailath: ESPRIT-estimation of signal parameters via rotational invariance techniques, IEEE Transactions on Acoustics, Speech and Signal Processing, vol. 37, no. 7, pp. 984995, July 1989). The diffuseness parameter $\Psi_i$ for each sector can, for example, be determined by evaluating the temporal variation of the DOA estimates (as described in J. Ahonen, V. Pulkki: Diffuseness estimation using temporal variation of intensity vectors, IEEE Workshop on Applications of Signal Processing to Audio and Acoustics, 2009. WAS-PAA '09., pp. 285-288, 18-21 Oct. 2009). Alternatively, known relations of the coherence between different microphones and the direct-to-diffuse sound ratio (as described in O. Thiergart, G. Del Galdo, E.A.P. Habets: Signal-to-reverberant ratio estimation based on the complex spatial coherence between omnidirectional microphones, IEEE International Conference on Acoustics, Speech and Signal Processing (ICASSP), 2012, pp. 309-312, 25-30 Mar. 2012) can be employed.

Figure 12:
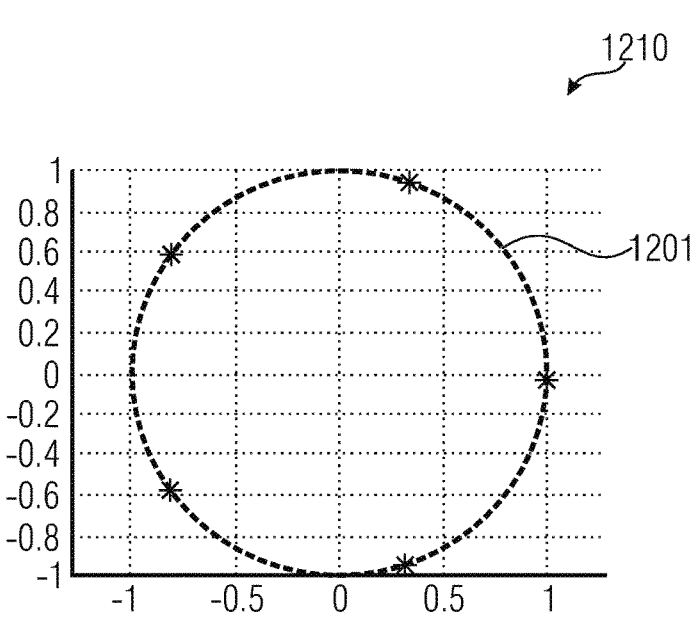
FIG. 12 shows a schematic illustration of an example circular array of omnidirectional microphones for obtaining higher order microphone signals.

FIG. 12 shows a schematic illustration 1200 of an example circular array of omnidirectional microphones 1210 for obtaining higher order microphone signals (e.g. the input spatial audio signal 105). In the schematic illustration 1200 of FIG. 12, the circular array of omnidirectional microphones 1210 comprises, for example, 5 equidistant microphones arranged along a circle (dotted line) in a polar diagram. In embodiments, the circular array of omnidirectional microphones 1210 can be used to obtain the higher order (HO) microphone signals, as will be described in the following. In order to compute the example second-order microphone signals U and V from the omnidirectional microphone signals (provided by the omnidirectional microphones 1210), at least 5 independent microphone signals should be used. This can be achieved elegantly, e.g. using a Uniform Circular Array (UCA) as the one exemplarily shown in FIG. 12. The vector obtained from the microphone signals at a certain time and frequency can, for example, be transformed with a DFT (Discrete Fourier transform). The microphone signals W, X, Y, U and V (i.e. the input spatial audio signal 105) can then be obtained by a linear combination of the DFT coefficients. Note that the DFT coefficients represent the coefficients of the Fourier series calculated from the vector of the microphone signals.

Let $\gamma_m$ denote the generalized m-th order microphone signal, defined by the directivity patterns $$\gamma_m^{(cos)} \Rightarrow \text{pattern: } \cos(m\vartheta)$$

$$\gamma_m^{(sin)} \Rightarrow \text{pattern: } \sin(m\vartheta) \quad (17)$$

where $\vartheta$ denotes an azimuth angle so that $$X = \gamma_1^{(cos)}$$

$$Y = \gamma_1^{(sin)}$$

$$U = \gamma_2^{(cos)}$$

$$V = \gamma_2^{(sin)} \quad (18)$$

Then, it can be proven that $$\gamma_m^{(cos)} = \frac{A_m}{2j^m} \quad (19)$$

$$\gamma_m^{(sin)} = \frac{B_m}{2j^m}$$

where $$A_m = \frac{1}{J_m(kr)}\left(\mathring{P}_m + \mathring{P}_{-m}\right)$$

$$B_m = j \cdot \frac{1}{J_m(kr)}\left(\mathring{P}_m - \mathring{P}_{-m}\right)$$

$$P(\varphi, r) = \sum_{m=-\infty}^{\infty} \mathring{P}_m e^{jm\varphi}$$

where j is the imaginary unit, k is the wave number, r and $\varphi$ are the radius and the azimuth angle defining a polar coordinate system, $J_m(\cdot)$ is the m-order Bessel function of the first kind, and $\mathring{P}_m$ are the coefficients of the Fourier series of the pressure signal measured on the polar coordinates (r, $\varphi$).

Note that care has to be taken in the array design and implementation of the calculation of the (higher order) B-format signals to avoid excessive noise amplification due to the numerical properties of the Bessel function.

Mathematical background and derivations related to the described signal transformation can be found, e.g. in A. Kuntz, *Wave field analysis using virtual circular microphone arrays*, Dr. Hut, 2009, ISBN: 978-3-86853-006-3.

Further embodiments of the present invention relate to a method for generating a plurality of parametric audio streams 125 ($\theta_i$, $\Psi_i$, $W_i$) from an input spatial audio signal 105 obtained from a recording in a recording space. For example, the input spatial audio signal 105 comprises an omnidirectional signal W and a plurality of different directional signals X, Y, Z, U, V. The method comprises providing at least two input segmental audio signals 115 ($W_i$, $X_i$, $Y_i$, $Z_i$) from the input spatial audio signal 105 (e.g. the omnidirectional signal W and the plurality of different directional signals X, Y, Z, U, V), wherein the at least two input segmental audio signals 115 ($W_i$, $X_i$, $Y_i$, $Z_i$) are associated with corresponding segments $Seg_i$ of the recording space. Furthermore, the method comprises generating a parametric audio stream for each of the at least two input segmental audio signals 115 ($W_i$, $X_i$, $Y_i$, $Z_i$) to obtain the plurality of parametric audio streams 125 ($\theta_i$, $\Psi_i$, $W_i$).

Further embodiments of the present invention relate to a method for generating a plurality of loudspeaker signals 525 ($L_1$, $L_2$, . . . ) from a plurality of parametric audio streams 125 ($\theta_i$, $\Psi_i$, $W_i$) derived from an input spatial audio signal 105 recorded in a recording space. The method comprises providing a plurality of input segmental loudspeaker signals 515 from the plurality of parametric audio streams 125 ($\theta_i$, $\Psi_i$, $W_i$), wherein the input segmental loudspeaker signals 515 are associated with corresponding segments $Seg_i$ of the recording space. Furthermore, the method comprises combining the input segmental loudspeaker signals 515 to obtain the plurality of loudspeaker signals 525 ($L_1$, $L_2$, . . . ).

Although the present invention has been described in the context of block diagrams where the blocks represent actual or logical hardware components, the present invention can also be implemented by a computer-implemented method. In the latter case, the blocks represent corresponding method steps where these steps stand for the functionalities performed by corresponding logical or physical hardware blocks.

The described embodiments are merely illustrative for the principles of the present invention. It is understood that modifications and variations of the arrangements and the details described herein will be apparent to others skilled in the art. It is the intent, therefore, to be limited only by the scope of the appending patent claims and not by the specific details presented by way of description and explanation of the embodiments herein.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus like, for example, a microprocessor, a programmable computer or an electronic circuit. In some embodiments, some one or more of the most important method steps may be executed by such an apparatus.

The parametric audio streams 125 ($\theta_i$, $\Psi_i$, $W_i$) can be stored on a digital storage medium or can be transmitted on a transmission medium such as a wireless transmission medium or a wired transmission medium such as the internet.

Depending on certain implementation requirements, embodiments of the invention can be implemented in hardware or in software. The implementation can be performed using a digital storage medium, for example a floppy disk, a DVD, a Blu-Ray, a CD, a ROM, an EPROM, an EEPROM or a FLASH memory, having electronically readable control signal stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive method is therefore a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is therefore a data stream or a sequence of signals representing the computer program for performing one of the methods described herein. The data stream or the sequence of signals may, for example, be configured to be transferred via a data communication connection, for example via the internet.

A further embodiment comprises a processing means, for example a computer or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may operate with a microprocessor in order to perform one of the methods described herein. Generally, the methods are advantageously performed by any hardware apparatus.

Embodiments of the present invention provide a high quality, realistic spatial sound recording and reproduction using simple and compact microphone configurations.

Embodiments of the present invention are based on directional audio coding (DirAC) (as described in T. Lokki, J. Merimaa, V. Pulkki: Method for Reproducing Natural or Modified Spatial Impression in Multichannel Listening, U.S. Pat. No. 7,787,638 B2, Aug. 31, 2010 and V. Pulkki: Spatial Sound Reproduction with Directional Audio Coding. J. Audio Eng. Soc., Vol. 55, No. 6, pp. 503-516, 2007), which can be used with different microphone systems, and with arbitrary loudspeaker setups. The benefit of the DirAC is to reproduce the spatial impression of an existing acoustical environment as precisely as possible using a multichannel loudspeaker system. Within the chosen environment, responses (continuous sound or impulse responses) can be measured with an omnidirectional microphone ($W_i$) and with a set of microphones that enables measuring the direction-of-arrival (DOA) of sound and the diffuseness of sound. A possible method is to apply three figure-of-eight microphones (X, Y, Z) aligned with the corresponding Cartesian coordinate axis. A way to do this is to use a "SoundField" microphone, which directly yields all the desired responses. It is interesting to note that the signal of the omnidirectional microphone represents the sound pressure, whereas the dipole signals are proportionate to the corresponding elements of the particle velocity vector.

Form these signals, the DirAC parameters, i.e. DOA of sound and the diffuseness of the observed sound field can be measured in a suitable time/frequency raster with a resolution corresponding to that of the human auditory system. The actual loudspeaker signals can then be determined from the omnidirectional microphone signal based on the DirAC parameters (as described in V. Pulkki: Spatial Sound Reproduction with Directional Audio Coding. J. Audio Eng. Soc., Vol. 55, No. 6, pp. 503-516, 2007). Direct sound components can be played back by only a small number of loudspeakers (e.g. one or two) using panning techniques, whereas diffuse sound components can be played back from all loudspeakers at the same time.

Embodiments of the present invention based on DirAC represent a simple approach to spatial sound recording with compact microphone configurations. In particular, the present invention prevents some systematic drawbacks which limit the achievable sound quality and experience in practice in conventional technology.

In contrast to conventional DirAC, embodiments of the present invention provide a higher quality parametric spatial audio processing. Conventional DirAC relies on a simple global model for the sound field, employing only one DOA and one diffuseness parameter for the entire observation space. It is based on the assumption that the sound field can be represented by only one single direct sound component, such as a plane wave, and one global diffuseness parameter for each time/frequency tile. It turns out in practice, however, that often this simplified assumption about the sound field does not hold. This is especially true in complex, real world acoustics, e.g. where multiple sound sources such as talkers or instruments are active at the same time. On the other hand, embodiments of the present invention do not result in a model mismatch of the observed sound field, and the corresponding parameter estimates are more correct. It can also be prevented that a model mismatch results, especially in cases where direct sound components are rendered diffusely and no direction can be perceived when listening to the loudspeaker outputs. In embodiments, decorrelators can be used for generating uncorrelated diffuse sound played back from all loudspeakers (as described in V. Pulkki: Spatial Sound Reproduction with Directional Audio Coding. J. Audio Eng. Soc., Vol. 55, No. 6, pp. 503-516, 2007). In contrast to conventional technology, where decorrelators often introduce an undesired added room effect, it is possible with the present invention to more correctly reproduce sound sources which have a certain spatial extent (as opposed to the case of using the simple sound field model of DirAC which is not capable of precisely capturing such sound sources).

Embodiments of the present invention provide a higher number of degrees of freedom in the assumed signal model, allowing for a better model match in complex sound scenes.

Furthermore, in case of using directional microphones to generate sectors (or any other time-invariant linear, e.g. physical, means), an increased inherent directivity of microphones can be obtained. Therefore, there is less need for applying time-variant gains to avoid vague directions, crosstalk, and coloration. This leads to less nonlinear processing in the audio signal path, resulting in higher quality.

In general, more direct sound components can be rendered as direct sound sources (point sources/plane wave sources). As a consequence, less decorrelation artifacts occur, more (correctly) localizable events are perceivable, and a more exact spatial reproduction is achievable.

Embodiments of the present invention provide an increased performance of a manipulation in the parametric domain, e. g. directional filtering (as described in M. Kallinger, H. Ochsenfeld, G. Del Galdo, F. Kuech, D. Mahne, R. Schultz-Amling, and O. Thiergart: A Spatial Filtering Approach for Directional Audio Coding, 126th AES Convention, Paper 7653, Munich, Germany, 2009), compared to the simple global model, since a larger fraction of the total signal energy is attributed to direct sound events with a correct DOA associated to it, and a larger amount of information is available. The provision of more (parametric) information allows, for example, to separate multiple direct sound components or also direct sound components from early reflections impinging from different directions.

Specifically, embodiments provide the following features. In the 2D case, the full azimuthal angle range can be split into sectors covering reduced azimuthal angle ranges. In the 3D case, the full solid angle range can be split into sectors covering reduced solid angle ranges. Each sector can be associated with an advantageous angle range. For each sector, segmental microphone signals can be determined from the received microphone signals, which predominantly consist of sound arriving from directions that are assigned to/covered by the particular sector. These microphone signals may also be determined artificially by simulated virtual recordings. For each sector, a parametric sound field analysis can be performed to determine directional parameters such as DOA and diffuseness. For each sector, the parametric directional information (DOA and diffuseness) predominantly describes the spatial properties of the angular range of the sound field that is associated to the particular sector. In case of playback, for each sector, loudspeaker signals can be determined based on the directional parameters and the segmental microphone signals. The overall output is then obtained by combining the outputs of all sectors. In case of manipulation, before computing the loudspeaker signals for playback, the estimated parameters and/or segmental audio signals may also be modified to achieve a manipulation of the sound scene.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An apparatus for generating a plurality of parametric audio streams from an input spatial audio signal acquired from a recording in a recording space, wherein the apparatus comprises:

a segmentor for generating at least two input segmental audio signals from the input spatial audio signal; wherein the segmentor is configured to generate the at least two input segmental audio signals depending on corresponding segments of the recording space, wherein the segments of the recording space each represent a subset of directions within a two-dimensional plane or within a three-dimensional space, and wherein the segments are different from each other; and a generator for generating a parametric audio stream for each of the at least two input segmental audio signals to acquire the plurality of parametric audio streams, so that the plurality of parametric audio streams each comprise a component of the at least two input segmental audio signals and a corresponding parametric spatial information, wherein the parametric spatial information of each of the parametric audio steams comprises direction-of-arrival parameter and/or a diffuseness parameter.

2. The apparatus according to claim 1, wherein the segments of the recording space each comprise an associated directional measure.

3. The apparatus according to claim 1, wherein the apparatus is configured for performing a sound field recording to acquire the input spatial audio signal;

wherein the segmentor is configured to divide a full angle range of interest into the segments of the recording space;

wherein the segments of the recording space each cover a reduced angle range compared to the full angle range of interest.

4. The apparatus according to claim 1, wherein the input spatial audio signal comprises an omnidirectional signal and a plurality of different directional signals.

5. The apparatus according to claim 4, wherein the segmentor is configured to generate the at least two input segmental audio signals from the omnidirectional signal and the plurality of the different directional signals using a mixing operation which depends on the segments of the recording space.

6. The apparatus according to claim 1, wherein the segmentor is configured to use a directivity pattern for each of the segments of the recording space;

wherein the directivity pattern indicates a directivity of the at least two input segmental audio signals.

7. The apparatus according to claim 6, wherein the directivity pattern is given by $$q_i(\vartheta)=a+b\cos(\varepsilon+\Theta_i),$$

wherein a and h denote multipliers which are modified to acquire a desired directivity pattern;

wherein $\vartheta$ denotes an azimuthal angle and $\Theta_i$ indicates an advantageous direction of the i'th segment of the recording space.

8. The apparatus according to claim 1, wherein the generator is configured for performing a parametric spatial analysis for each of the at least two input segmental audio signals to acquire the corresponding parametric spatial information.

9. The apparatus according to claim 1, further comprising:

a modifier for modifying the plurality of parametric audio streams in a parametric signal representation domain;

wherein the modifier is configured to modify at least one of the parametric audio streams using a corresponding modification control parameter.

10. An apparatus for generating a plurality of loudspeaker signals from a plurality of parametric audio streams; wherein each of the plurality of parametric audio streams comprises a segmental audio component and a corresponding parametric spatial information; wherein the parametric spatial information of each of the parametric audio steams comprises a direction-of-arrival parameter and/or a diffuseness parameter; wherein the apparatus comprises:

a renderer for providing a plurality of input segmental loudspeaker signals from the plurality of parametric audio streams, so that the input segmental loudspeaker signals depend on corresponding segments of a recording space, wherein the segments of the recording space each represent a subset of directions within a two-dimensional plane or within a three-dimensional space, and wherein the segments are different from each other; wherein the renderer is configured for rendering each of the segmental audio components using the corresponding parametric spatial information to acquire the plurality of input segmental loudspeaker signals; and a combiner for combining the input segmental loudspeaker signals to acquire the plurality of loudspeaker signals.

11. A method for generating a plurality of parametric audio streams from an input spatial audio signal acquired from a recording in a recording space, wherein the method comprises:

generating t least two input segmental audio signals from the input spatial audio signal; wherein generating the at least two input segmental audio signals is conducted depending on corresponding segments of the recording space, wherein the segments of the recording space each represent a subset of directions within a two-dimensional plane or within a three-dimensional space, and wherein the segments are different from each other;

generating a parametric audio stream for each of the at least two input segmental audio signals to acquire the plurality of parametric audio streams, so that the plurality of parametric audio streams each comprise a component of the at least two input segmental audio signals and a corresponding parametric spatial information, wherein the parametric spatial information of each of the parametric audio steams comprises direction-of-arrival parameter and/or a diffuseness parameter.

12. A non-transitory computer-readable medium comprising a computer program comprising a program code for performing the method according to claim 11 when the computer program is executed on a computer.

13. A method for generating a plurality of loudspeaker signals from a plurality of parametric audio streams; wherein each of the plurality of parametric audio streams comprises a segmental audio component and a corresponding parametric spatial information; wherein the parametric spatial information of each of the parametric audio steams comprises a direction-of-arrival parameter and/or a diffuseness parameter; wherein the method comprises:

providing a plurality of input segmental loudspeaker signals from the plurality of parametric audio streams, so that the input segmental loudspeaker signals depend on corresponding segments of a recording space, wherein the segments of the recording space each represent a subset of directions within a two-dimensional plane or within a three-dimensional space, and wherein the segments are different from each other; wherein providing the plurality of input segmental loudspeaker signals is conducted by rendering each of the segmental audio components using the corresponding parametric spatial information to acquire the plurality of input segmental loudspeaker signals; and combining the input segmental loudspeaker signals to acquire the plurality of loudspeaker signals.

14. A non-transitory computer-readable medium comprising a computer program comprising a program code for performing the method according to claim 13 when the computer program is executed on a computer.

* * * * *